US011633028B2

(12) United States Patent
Kim et al.

(10) Patent No.: US 11,633,028 B2
(45) Date of Patent: Apr. 25, 2023

(54) DIFFUSER AND HAIR DRYER HAVING A DIFFUSER

(71) Applicant: LG ELECTRONICS INC., Seoul (KR)

(72) Inventors: Kyoungtae Kim, Seoul (KR); Hyunchul Kim, Seoul (KR); Yunhee Ku, Seoul (KR); Rayoung Park, Seoul (KR); Dongwon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 185 days.

(21) Appl. No.: 17/077,922

(22) Filed: Oct. 22, 2020

(65) Prior Publication Data

US 2021/0315354 A1 Oct. 14, 2021

(30) Foreign Application Priority Data

Apr. 10, 2020 (KR) ..... 10-2020-0044036

(51) Int. Cl.
*A45D 20/12* (2006.01)

(52) U.S. Cl.
CPC ..... *A45D 20/122* (2013.01); *A45D 2200/205* (2013.01)

(58) Field of Classification Search
CPC ..... A45D 20/122; A45D 20/00; A45D 20/12; A45D 2200/205
USPC ..... 34/95–100
See application file for complete search history.

(56) References Cited

U.S. PATENT DOCUMENTS

| | | | | |
|---|---|---|---|---|
| 939,106 | A | 11/1909 | Soles | |
| 2,560,808 | A | 7/1951 | MacCallum | |
| 3,265,075 | A | 8/1966 | Edman | |
| 5,275,339 | A | 1/1994 | Andis et al. | |
| 5,715,847 | A | 2/1998 | Rolf | |
| 6,070,597 | A * | 6/2000 | Motherhead | A46B 7/04 132/262 |
| D477,112 | S | 7/2003 | Yeung | |
| 6,601,316 | B2 | 8/2003 | Shaw, II | |
| 7,040,037 | B2 | 5/2006 | Keong | |
| 7,946,056 | B2 | 5/2011 | Kroll | |
| 8,387,271 | B2 | 3/2013 | Shami et al. | |
| 8,434,238 | B2 | 5/2013 | Gross et al. | |

(Continued)

FOREIGN PATENT DOCUMENTS

| | | |
|---|---|---|
| CN | 1167430 | 12/1997 |
| CN | 203884936 | 10/2014 |

(Continued)

OTHER PUBLICATIONS

International Search Report issued in Application No. PCT/KR2020/012282 dated Jul. 22, 2021.

(Continued)

*Primary Examiner* — Stephen M Gravini
(74) *Attorney, Agent, or Firm* — KED & Associates

(57) ABSTRACT

A hair dryer includes a main body, a handle, and a diffuser. The diffuser includes a diffusing case and a discharge cover. The discharge cover includes a plurality of massage protrusions protruding forward to press a target located in front of the discharge cover and at least one moisture measurement protrusion provided to measure a moisture amount of the target.

20 Claims, 11 Drawing Sheets

(56) References Cited

U.S. PATENT DOCUMENTS

| | | | | |
|---|---|---|---|---|
| 8,720,078 | B1 * | 5/2014 | Behbehani | A45D 20/10 34/97 |
| 9,144,286 | B2 | 9/2015 | Courtney | |
| 9,936,788 | B2 | 4/2018 | Stephens et al. | |
| 10,165,843 | B2 | 1/2019 | Hedges | |
| 10,278,471 | B2 | 5/2019 | Shelton et al. | |
| 10,470,545 | B2 * | 11/2019 | Thiebaut | A46B 15/0006 |
| 10,610,001 | B2 | 4/2020 | Kim | |
| 10,660,418 | B2 | 5/2020 | deGrood et al. | |
| 10,702,037 | B2 | 7/2020 | Boateng | |
| 10,869,529 | B2 | 12/2020 | Chia | |
| 10,874,186 | B2 | 12/2020 | MacPherson | |
| D935,688 | S | 11/2021 | Park | |
| 2003/0079367 | A1 | 5/2003 | Troletti | |
| 2009/0000141 | A1 | 1/2009 | Gross et al. | |
| 2016/0367006 | A1 | 12/2016 | Stephens et al. | |
| 2016/0367008 | A1 | 12/2016 | Stephens et al. | |
| 2017/0105501 | A1 | 4/2017 | Palmer | |
| 2021/0315350 | A1 * | 10/2021 | Kim | A45D 20/122 |
| 2021/0315353 | A1 | 10/2021 | Kim et al. | |
| 2021/0315354 | A1 * | 10/2021 | Kim | A45D 20/122 |
| 2021/0315356 | A1 * | 10/2021 | Kim | A46B 5/04 |

FOREIGN PATENT DOCUMENTS

| | | |
|---|---|---|
| CN | 104273918 | 1/2015 |
| CN | 107529865 | 1/2018 |
| CN | 109247685 | 1/2019 |
| CN | 106539271 | 11/2019 |
| CN | 209732900 | 12/2019 |
| FR | 2766338 | 1/1999 |
| JP | 01-055803 | 4/1989 |
| JP | 2012-019865 | 2/2012 |
| JP | 2012-239535 | 12/2012 |
| JP | 2013-162830 | 8/2013 |
| JP | 2018-015539 | 2/2018 |
| JP | 6346700 | 6/2018 |
| JP | 2018-134441 | 8/2018 |
| JP | 2018-175726 | 11/2018 |
| JP | 3222699 | 8/2019 |
| KR | 20-1985-0002139 | 10/1985 |
| KR | 10-1997-0706745 | 12/1997 |
| KR | 20-1998-0026628 | 8/1998 |
| KR | 10-2001-0086200 | 9/2001 |
| KR | 10-2010-0066043 | 6/2010 |
| KR | 20-2011-0002484 | 3/2011 |
| KR | 10-1056026 | 8/2011 |
| KR | 10-1155135 | 6/2012 |
| KR | 20-0468263 | 8/2013 |
| KR | 2016-502432 | 1/2016 |
| KR | 2016-072174 | 5/2016 |
| KR | 20-2016-0002206 | 6/2016 |
| KR | 10-2016-0095646 | 8/2016 |
| KR | 10-2015-0023773 | 1/2017 |
| KR | 10-1758360 | 7/2017 |
| KR | 10-2017-0139520 | 12/2017 |
| KR | 10-2017-0138806 | 2/2018 |
| KR | 10-2018-0017193 | 2/2018 |
| KR | 10-1872227 | 6/2018 |
| KR | 20-2018-0003263 | 11/2018 |
| KR | 10-2018-0130756 | 12/2018 |
| KR | 10-1928531 | 12/2018 |
| KR | 10-2019-0072169 | 6/2019 |
| KR | 10-1988303 | 6/2019 |
| KR | 10-2019-0084801 | 7/2019 |
| KR | 10-2020-0033086 | 3/2020 |
| KR | 10-2020-0033115 | 3/2020 |
| TW | 201914475 | 4/2019 |
| TW | 201914476 | 4/2019 |
| TW | 201936080 | 9/2019 |
| WO | WO 2011/100711 | 8/2011 |
| WO | WO 2020/165554 | 8/2020 |
| WO | WO 2021/090155 | 5/2021 |

OTHER PUBLICATIONS

International Search Report issued in Application No. PCT/KR2020/012288 dated Jul. 26, 2021.
Taiwanese Notice of Allowance dated Jan. 5, 2022 issued in Application No. 109136741 (English translation attached).
U.S. Appl. No. 17/085,385, filed Oct. 30, 2020.
Taiwanese Notice of Allowance dated Apr. 28, 2022 issued in Application No. 109137300 (English translation attached).
International Search Report issued in Application No. PCT/KR2020/012272 dated Jul. 22, 2021.
International Search Report issued in Application No. PCT/KR2020/012273 dated Jul. 22, 2021.
International Search Report issued in Application No. PCT/KR2020/012284 dated Jul. 22, 2021.
International Search Report issued in Application No. PCT/KR2020/012286 dated Jul. 22, 2021.
International Search Report issued in Application No. PCT/KR2020/012292 dated Jul. 22, 2021.
International Search Report issued in Application No. PCT/KR2020/012289 dated Jul. 27, 2021.
Korean Office Action issued in Application No. 10-2020-0044041 dated Aug. 6, 2021.
Taiwan Office Action issued in Application No. 109137300 dated Aug. 13, 2021.
Taiwan Office Action issued in Application No. 109136742 dated Aug. 13, 2021.
Taiwan Office Action issued in Application No. 109136743 dated Aug. 13, 2021.
Taiwan Office Action issued in Application No. 109136745 dated Aug. 13, 2021.
Taiwanese Notice of Allowance dated Oct. 18, 2021 issued in TW Application No. 109136744.
Korean Notice of Allowance dated Nov. 16, 2021 issued in KR Application No. 10-2020-0044040.
Korean Notice of Allowance dated Nov. 18, 2021 issued in KR Application No. 10-2020-0044038.
U.S. Office Action dated Jul. 20, 2022 issued in U.S. Appl. No. 17/077,929.
U.S. Appl. No. 17/077,915, filed Oct. 22, 2020.
U.S. Appl. No. 17/077,917, filed Oct. 22, 2020.
U.S. Appl. No. 17/077,921, filed Oct. 22, 2020.
U.S. Appl. No. 17/077,922, filed Oct. 22, 2020.
U.S. Appl. No. 17/077,927, filed Oct. 22, 2020.
U.S. Appl. No. 17/077,929, filed Oct. 22, 2020.
U.S. Appl. No. 17/077,119, filed Oct. 22, 2020.
U.S. Office Action dated Sep. 23, 2022 issued in U.S. Appl. No. 17/077,917.
United States Notice of Allowance dated Oct. 12, 2022 issued in co-pending related U.S. Appl. No. 17/077,921.

* cited by examiner

DIFFUSER AND HAIR DRYER HAVING A DIFFUSER

CROSS-REFERENCE TO RELATED APPLICATION(S)

This application claims the benefit of Korean Patent Application No. 10-2020-0044036, filed in Korea on Apr. 10, 2020, which is hereby incorporated by reference as if fully set forth herein.

BACKGROUND

1. Field

The present disclosure relates to a diffuser and a hair dryer including a diffuser.

2. Background

When removing moisture from wet hair or when styling hair, a hair dryer that discharges gas or air through a gas outlet may be used. In one example, the hair dryer may provide air or gas having certain characteristics desired by a user, such as a desired gas temperature, a desired gas speed, and a desired gas flow shape or area, through a diffuser. The diffuser may be coupled to a main body of the hair dryer to change the gas characteristics. Further, the diffuser may include a care device such as massage protrusions or bristles to manage scalp health and the like.

Korean Utility Model Application Publication No. 20-2011-0002484 discloses a diffuser provided in a hair dryer having a massage protrusion that may perform user scalp and hair care.

Depending on conditions of the user's scalp and hair, uniform application of the means provided for the management of the user's scalp or hair may degrade efficiency or ease of use. Therefore, it is important to provide various means for the management and care of the user's scalp or hair, and to provide appropriate care means based on the conditions of the user's scalp or hair.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
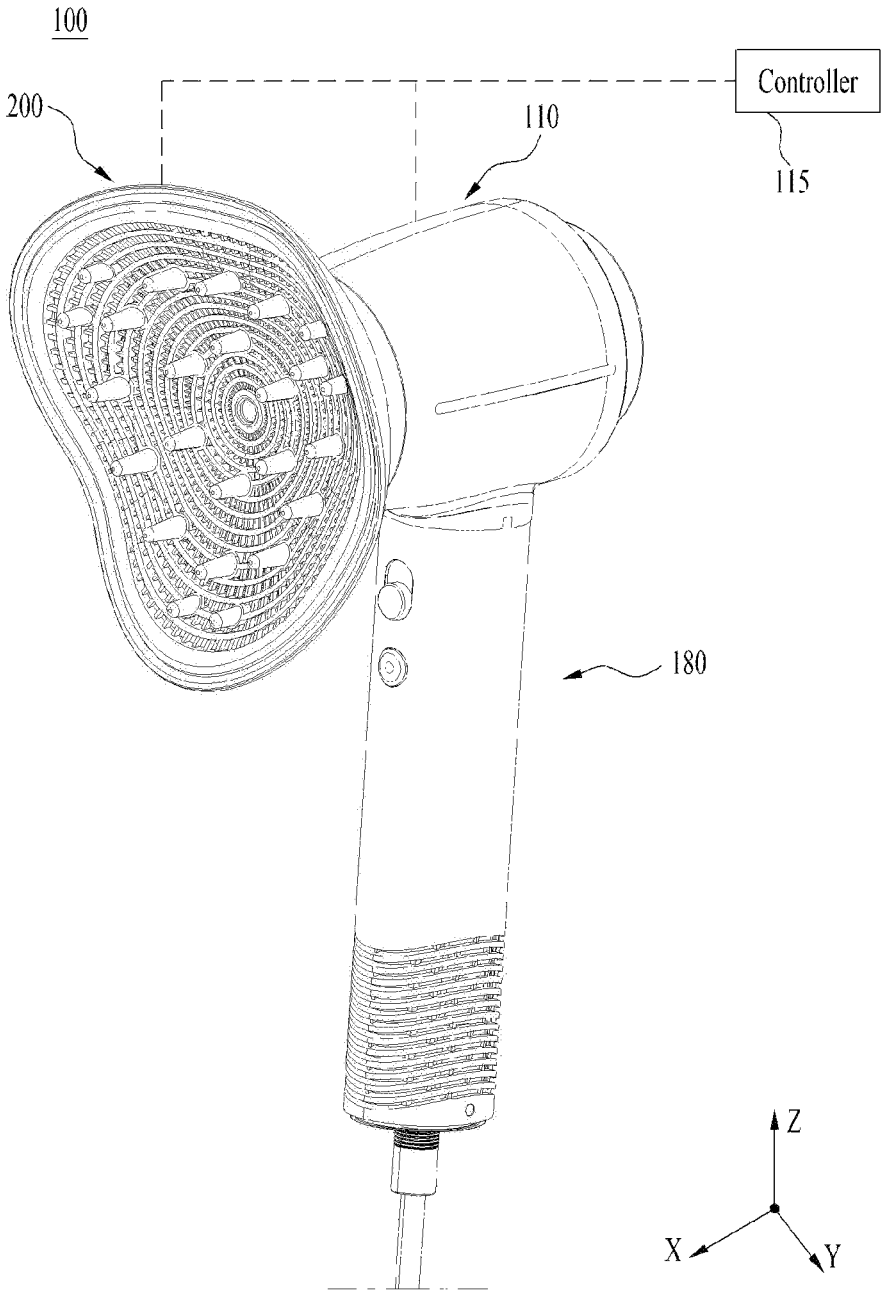
FIG. 1 is a view showing a hair dryer according to an embodiment.
Figure 2:
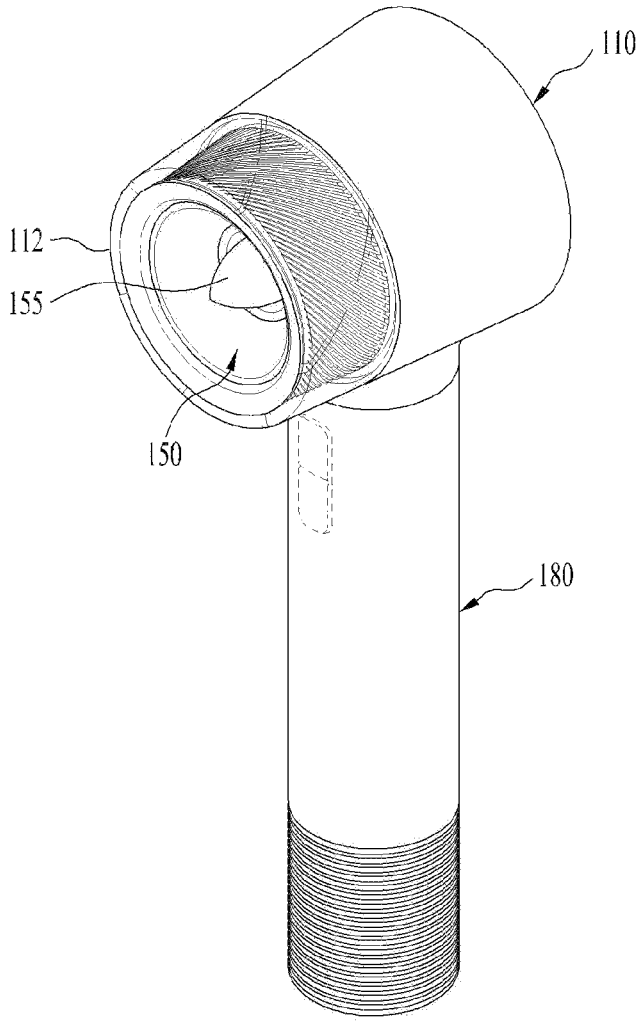
FIG. 2 is a view showing a state in which a diffuser is separated from a hair dryer according to an embodiment.
Figure 3:
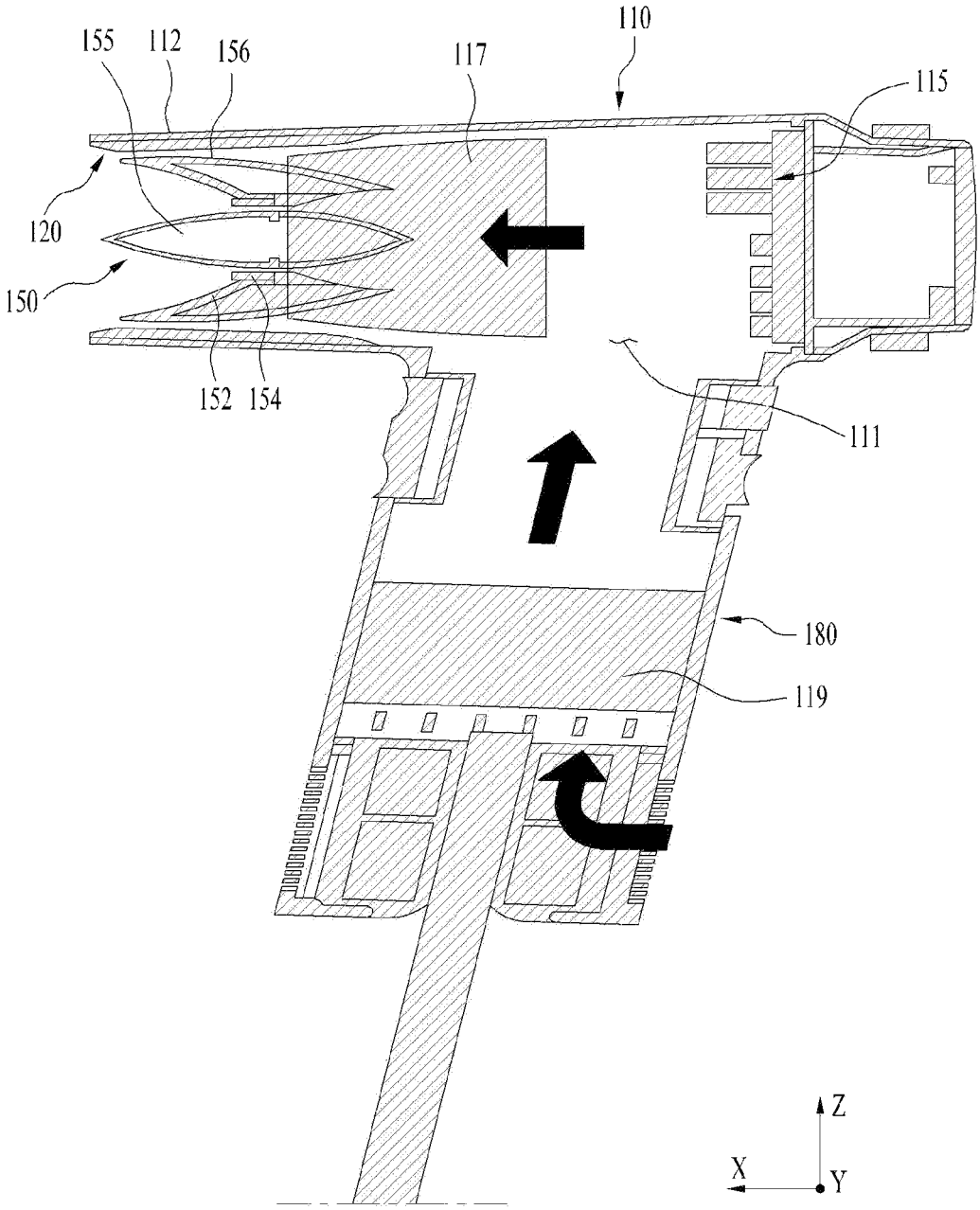
FIG. 3 is a view showing an internal cross-section of the hair dryer shown in FIG. 2.

Referring to FIGS. 1-3, a hair dryer 100 may include a main body 110, a handle 180, and a diffuser 200 as shown in FIG. 1. In addition, as shown in FIG. 2, the main body 110 may include a gas or air outlet 150 through which gas or air introduced from outside is discharged.

As shown in FIG. 3, the main body 110 may include a gas or air flow path 111 through which the introduced gas flows. The gas inside of the gas flow path 111 may be discharged through the gas outlet 150 to the outside. The main body 110 may have an extended shape along a front-rear direction and may have various cross-sectional shapes such as circular, elliptical, stadium, or polygonal shapes when viewed from the front.

In the present disclosure, front, rear, left, right, top, and bottom definitions may be made centering on the main body 110. Referring to FIG. 2, the gas outlet 150 may be provided at a front side of the main body 110, and the handle 180 may have a shape extending substantially downward from the main body 110.

The gas flowing inside the main body 110 may be introduced through a gas inlet, which may be provided on the handle 180 (as shown in FIG. 3) or alternatively on the main body 110 (for example, at a rear of the main body 110). As shown in FIGS. 1 to 3, when the gas inlet is provided on the handle 180, the gas flow path 111 may extend from gas inlet formed in the handle 180 toward the gas outlet 150 of the main body 110, or upward and frontward. The gas may be introduced or suctioned from the outside through the gas inlet, and the introduced gas may flow along the gas flow path 111 and be discharged to the outside through the gas outlet 150.

The handle 180 may be a portion of the hair dryer 100 grabbed by a hand of a user, and may have a shape that improves grip convenience. The handle 180 may extend downward from the main body 110, as illustrated in FIGS. 1 to 3, but embodiments disclosed herein are not limited to a downward handle 180. The handle 180 may be integrally molded with the main body 110, or separately manufactured from the main body 110 and later coupled to the main body 110.

When the handle 180 is manufactured separately from the main body 110 and later coupled to the main body 110, the handle 180 may be provided such that a longitudinal direction thereof with respect to the main body 110 is fixed or variable. For example, the handle 180 may have a hinge coupling portion or hinge structure, and may be coupled to the main body 110 such that the longitudinal direction of the handle 180 is changeable (e.g., foldable) relative to the main body 110 so as to make grasping and/or styling convenient.

The extending direction of the handle 180 may vary. However, for convenience of description below, the direction in which the handle 180 extends from the main body 110 will be described as a downward direction.

Referring to FIG. 3, the hair dryer 100 according to an embodiment may include a fan 119 capable of moving (e.g., suctioning and/or discharging) gas or air and adjusting a speed of the gas or air discharged through the gas outlet 150. The fan 119 may be provided in the gas flow path 111 to blow the gas. The fan 119 may be provided inside the handle 180 (as illustrated) or alternatively inside of the main body 110 (e.g., a rear of the main body 110).

The fan 119 may be provided near or adjacent to the gas inlet. For example, when the gas inlet is provided in the handle 180, the gas flow path 111 may extend from the gas inlet of the handle 180 to the gas outlet 150, and the fan 119 may be provided in a portion of the gas flow path 111 located in the handle 180.

A temperature adjuster 117 (e.g., a heater or cooler) may be provided inside of the main body 110 (or alternatively, the handle 180) to adjust a temperature of the discharged gas. The temperature adjuster 117 may be provided in various forms and may be provided at various positions. In FIG. 2, the temperature adjuster 117 is provided inside the main body 110.

In addition, the temperature adjuster 117 may be provided in various types. The temperature adjuster 117 may use a heating scheme by providing current to a coil-shaped resistor to generate heat. However, the resistor of the temperature adjuster 117 may not necessarily be in the shape of the coil, and may be provided in various types, such as a thermoelement capable of heating the gas or adjusting the temperature of the gas. As another example, the temperature adjuster 117 may include a thermoelectric cooler (TEC) or Peltier device to provide cool air.

A method for operating the hair dryer 100 according to an embodiment of the present disclosure will be schematically described with respect to gas or air flow.

First, the user may manipulate or operate a power button provided on the main body 110 or the handle 180. When the power button is turned on, the fan 119 may be operated, and gas may be introduced or suctioned into the hair dryer 100.

The gas introduced through the gas inlet flows along the gas flow path 111 via the fan 119 toward the gas outlet 150, and the gas is discharged through the gas outlet 150 to the user. In this process, a flow speed of the gas along the gas flow path 111 may be adjusted by the fan 119, and a temperature of the gas flowing along the gas flow path 111 may be adjusted by the temperature adjuster 117.

In one example, the hair dryer 100 according to an embodiment may include a controller 115. The controller 115 may be connected not only to the fan 119, the temperature adjuster 117, the power button, and a manipulator or user interface to select a desired temperature or flow speed, but also to a light irradiator or light 260 (FIG. 6), a proximity sensor 269 (FIG. 6), a moisture measurement protrusion or sensor 312 (FIG. 6), and the like, which may be provided on the diffuser 200 and to be described later. The controller 115 may control the above described components.

The controller 115 may be provided on one of the diffuser 200, the main body 110, or the handle 180. Alternatively, a plurality of controllers 115 may be respectively arranged on all of the diffuser 200, the main body 110, and the handle 180. As indicated in FIG. 3, the controller 115 may be provided on the main body 110 to be signally connected to the diffuser 200, or, as indicated by the dotted lines in FIG. 1, a plurality of controllers 115 may be respectively arranged on the diffuser 200 and the main body 110.

Figure 6:
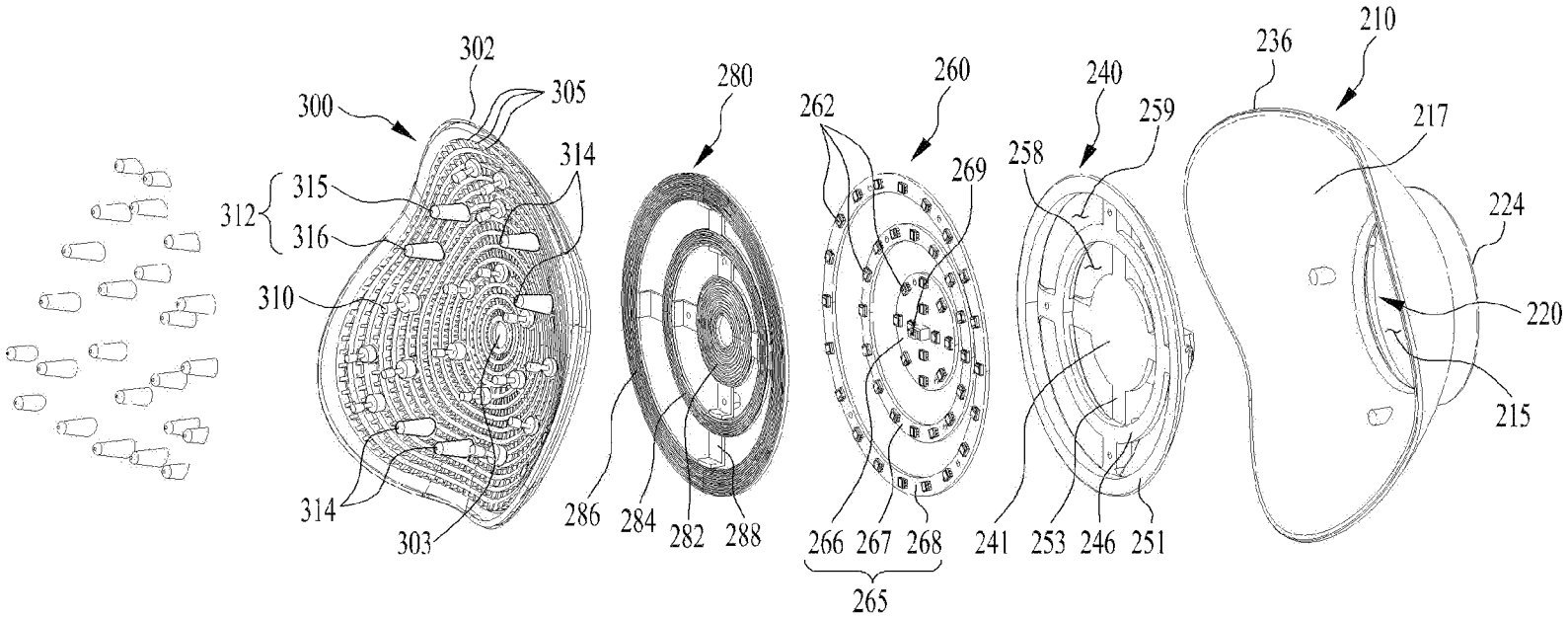
FIG. 6 is a view showing an exploded view of a diffuser according to an embodiment.

Adjusting operating states of the fan 119 and the temperature adjuster 117 may be performed by manipulation of the manipulator or user interface by the user or may be automatically performed based on an operation mode preset or predetermined in the controller 115. In addition, when a distance to a target located in front of the diffuser 200 is identified to be equal to or less than a reference or predetermined distance through the proximity sensor 269 of the diffuser 200, the controller 115 may control the light irradiator 260 of the diffuser 200 to irradiate light (FIG. 6).

The controller 115 may identify an impedance of the target located in front of the diffuser 200 through the moisture measurement protrusion 312 of the diffuser 200, and determine a moisture amount of the target through the impedance. As the moisture amount increases, the controller 115 may control the fan 119 such that the speed of the gas discharged through the gas outlet 150 increases, control the temperature adjuster 117 such that the gas temperature increases, or control the light irradiator 260 such that a light amount of the light irradiator 260 increases.

As shown in FIG. 1 or 3, the main body 110, where the gas outlet 150 is provided, may have a cross-section in an approximately circular shape and may have a front-rear length that is longer than a left-right width or diameter of the cross-section. However, the cross-section shape of the main body 110 may be varied as needed.

Figure 4:
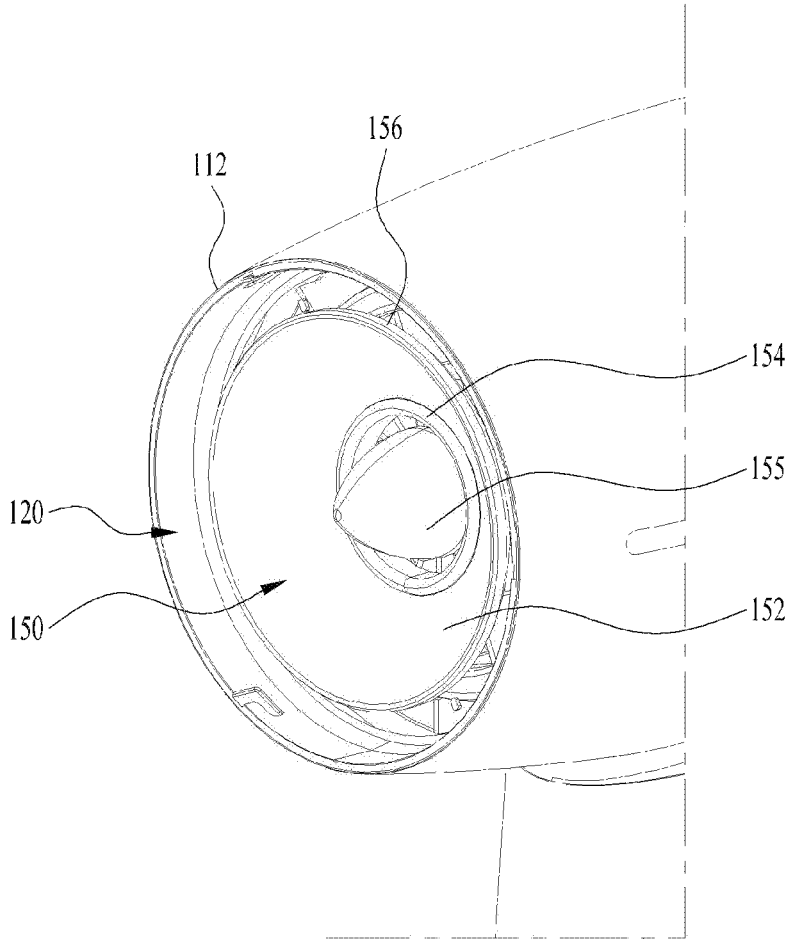
FIG. 4 is a view showing a gas outlet in a hair dryer according to an embodiment.

The gas outlet 150 of the hair dryer 100 according to an embodiment of the present disclosure will be described in detail with reference to FIG. 3. At least a portion of the gas flow path 111 may be defined inside the main body 110, and at least one side of the main body 110 may be opened or have an opening. For example, the main body 110 may extend in the front and rear direction, and a front surface thereof may be opened at a front end 112 (FIG. 4). The front end 112 may be a wall or front rim defining a front opening. The front opening of the main body 110 may be in communication with the gas flow path 111. The gas outlet 150 may be defined by an inner rim or surface of the front end 112. The front opening of the main body 110 may correspond to an end of the gas flow path 111, and the end of the gas flow path 111 may correspond to the gas outlet 150.

Referring to FIG. 4, in one example, the gas outlet 150 may include a discharge base or disc 152, which may be provided at the front opening of the main body 110. The discharge base 152 may be concentric with or provided inside of the front end 112. An outer edge of the discharge base 152 may be spaced apart from the front end 112 to define a side portion or opening 156 therebetween. The discharge base may have a center portion or opening 154. Gas may be discharged through the side and center openings 154 and 156, which may alternatively be referred to as outer and inner openings. The gas flowing along the gas flow path 111 may be simultaneously delivered to the center opening 154 and the side opening 156 to be discharged to the outside.

The center opening 154 and the side opening 156 may correspond to discharge holes through which the gas is discharged from the gas outlet 150. The center opening 154 may be defined at a central side on the cross-section of the gas outlet 150, and a cross-sectional shape thereof may be circular. However, embodiments disclosed herein are not limited to circular cross-sections, and a shape of the center opening 154 may be a polygonal shape such as a square as needed, and a size of a diameter, width, or cross-sectional area thereof may also be varied as needed.

The side opening 156 may surround the center opening 154. For example, as shown in FIG. 4, the center opening 154 may be defined in a substantially circular shape at the center of the discharge base 152 and/or a center of the entire gas outlet 150, and the side opening 156 may be an opening in a shape of a ring surrounding the discharge base 152. The ring shape may have an extended shape and/or a closed curve shape. For example, FIG. 4 discloses the side opening 156 having a circular ring shape. However, the ring shape of the side opening 156 may not necessarily be circular, and may be, for example, a polygonal ring shape such as a triangle or a square.

An optional guide cone 155 may be provided inside of the center opening 154 such that gas flows through a ring-shaped opening defined between, on the one hand, an inner side of the discharge base 152 defining the center opening 154, and, on the other hand, an outer surface of the guide cone 155. Details of the discharge base 152 and guide cone 155 will be described later. Like the shape of the side opening 156, the shape of the portion of the center opening 154 outside of the guide cone 155 is not limited to a circular ring shape, and may be, for example, a polygonal ring shape such as a triangle or a square.

The center opening 154 and the side opening 156 may be in communication with a same portion of the gas flow path 111. The center opening 154 may be concentric with the side opening 156.

A cross-sectional area of the entirety of the discharged gas may correspond to a size of an entire cross-section formed by the front end 112. However, The discharge base 152 may block a portion of the gas flowing through the gas outlet 150. The discharged gas may be diffused while flowing through the side opening 156, and a portion of the gas flow may be distributed toward a center of the cross-section where the gas is not discharged (i.e., toward the discharge base 152), and thus, the cross-sectional area of the discharge gas may be reduced.

The center opening 154 may be defined at a center of the side opening 156, and the gas of the side opening 156 that is distributed toward the center of the discharge base 152 may be suppressed by gas discharged through the center opening 154. The gas flowing through the center opening 154 may suppress the gas flowing through the side opening 156 and prevent the gas flowing through the side opening 156 from being distributed toward the center of the gas outlet 150, and an entire discharged gas may maintain an initial cross-sectional area thereof.

Gas flowing through the center and side openings 54 and 156 may have a large cross-sectional area, facilitating a drying process. For example, an entire volume of gas discharged through the center opening 154 and the side opening 156 may be sufficient to allow the user to dry a larger area.

Since the center opening 154 and the side opening 156 may be in communication with the same cross-sectional area of the gas flow path 111, there may not necessarily be separate gas flow paths 111 for the center opening 154 and the side opening 156. Thus, provided three-dimensional gas discharge to the user may be efficient.

The center opening 154 may be defined at a center of the discharge base 152, and the side opening 156 may be defined between an outer circumferential surface of the discharge base 152 and the front end 112 of the main body 110, which may be a wall or rim defining the front opening.

The discharge base 152 may be coupled to the front end 112 of the main body 110 and may have a same cross-sectional shape of the front opening, but embodiments disclosed herein are not be limited thereto and may be formed in various shapes or materials. For example, the discharge base 152 may be provided to be partially different from the shape of the front opening of the main body 110 to determine the shape of the side opening 156, and may be molded with a material that is the same as or different from a material of the front end 112 or outer wall of the main body 110.

The discharge base 152 may constitute an entirety or a portion of one surface (e.g., the front surface) of the main body 11, so that the center opening 154 may be defined at the center of the discharge base 152, and the side opening 156 may be defined between the outer circumferential surface of the discharge base 152 and the front end 112 of the main body 110.

The discharge base 152 may be coupled to an opening of the main body 110 in various schemes, such as a scheme using a plurality of coupling ribs and/or may be integrally molded with the main body 110.

In one example, as shown in FIG. 4, the discharge base 152 may be indented or recessed toward an interior of the main body 110 from the front end 112 such that a front rim of the front end 112 protrudes further forward than a front surface of the discharge base 152.

Furthermore, a center of the front surface of the discharge base 152 may be indented or recessed toward the interior of the main body 110 such that the front surface of the discharge base 152 may form a curved or bent surface. Accordingly, the gas discharged through the center opening 154 may be discharged upstream or before the gas discharged through the side opening 156.

When the gas discharged through the center opening 154 starts to be diffused prior to the gas discharged through the side opening 156, the cross-sectional area of the gas discharged through the central opening 154 may be increased through diffusion, and may suppress a flow of the gas discharged through the side opening 156 toward a center. Further, a curvature of the curved surface of the front surface of the discharge base 152 may be variously set as necessary to prevent or reduce turbulence.

A guide cone 155 may be provided at a center of the center opening 154 to guide a flow of the gas discharged through the center opening 154. The gas may be discharged between an inner surface of the center opening 154 and the guide cone 155.

FIG. 4 illustrates the guide cone 155 provided at the center of the center opening 154. As the guide cone 155 is provided, the gas flowing through the center opening 154 is discharged into a space between the inner surface of the center opening 154 and an outer surface of the guide cone 155.

When the guide cone 155 is provided at the center of the center opening 154, the gas may flow through an outer portion of the center opening 154, which may be a ring-shaped discharge hole. The gas discharged through the center opening 154 may have a ring-shaped cross-section.

The gas discharged through the center opening 154 may contribute to suppressing a reduction of a cross-sectional area of the gas discharged through the side opening 156 by blocking some gas discharged through the side opening 156 from flowing toward inward toward a center in the flow process. In addition, the guide cone 155 may increase a level or speed at which the gas discharged through the center opening 154 diffuses outward.

When the cross-sectional area of the gas discharged through the center opening 154 is increased due to the guide cone 155, the suppression of inward flow of gas discharged through the side opening 156 may be increased.

In one example, in the guide cone 155, a rear end protruding toward the gas flow path 111 and a front end protruding in a discharge direction of the gas of the center opening 154 may respectively have conical shapes. The conical shape may mean a shape in which a cross-sectional area has a circular or elliptical shape, and where a diameter or width of the circle gradually decreases as a length increases.

However, in the conical shape, the circular shape of the cross-sectional area is not limited to perfect circles and may have, for example an ellipse or stadium shape. Furthermore, a reduction in the diameter may not necessarily be constant; for example, a diameter reduction rate may gradually increase or gradually decrease.

As the front end of the guide cone 155 protrudes in the conical shape, the gas discharged through the center opening 154 may be increasingly concentrated toward a rim of the center opening 154. Thus, a flow of the gas discharged through the side opening 156 and flowing toward the center opening 154 may be further suppressed.

An outer circumferential surface of the guide cone 155 may have a shape or size corresponding to an inner circumferential surface of the center opening 154, and a separation distance between the outer circumferential surface of the guide cone 155 and the inner circumferential surface of the center opening 154 may be varied as needed. Further, the guide cone 155 may be made of a material the same as or different from the material of the discharge base 152, and a curvature of the outer surface thereof may be variously designed as needed.

In one example, the gas outlet 150 may further include a discharge guide ring. The discharge guide ring may be provided on the inner surface of the center opening 154 and protrude in the discharge direction of the gas discharged through the center opening 154 to guide the gas flow together with the guide cone 155. FIG. 4 illustrates that the guide cone 155 and the discharge guide ring may be arranged in the center opening 154.

The discharge guide ring may have a ring shape extending along the rim of the center opening 154, and may be integrally molded with the discharge base 152 or molded separately from the discharge base 152 to be later coupled to the inner circumferential surface of the center opening 154.

The discharge guide ring may protrude outward or forward and rearward from the center opening 154 or the discharge base 152 and/or protrude based on the gas discharge direction. The flow of the gas through the center opening 154 may be concentrated between the guide cone 155 and the discharge guide ring by the guide cone 155 and the discharge guide ring protruding from the center opening 154. A protruding end of the discharge guide ring may have a curved shape to facilitate the gas flow. A diameter of the discharge guide ring may be different for each portion, and a shape thereof may also be varied as needed. The front end 112 of the main body 110 may include a first coupling member 120 described later.

Figure 5:
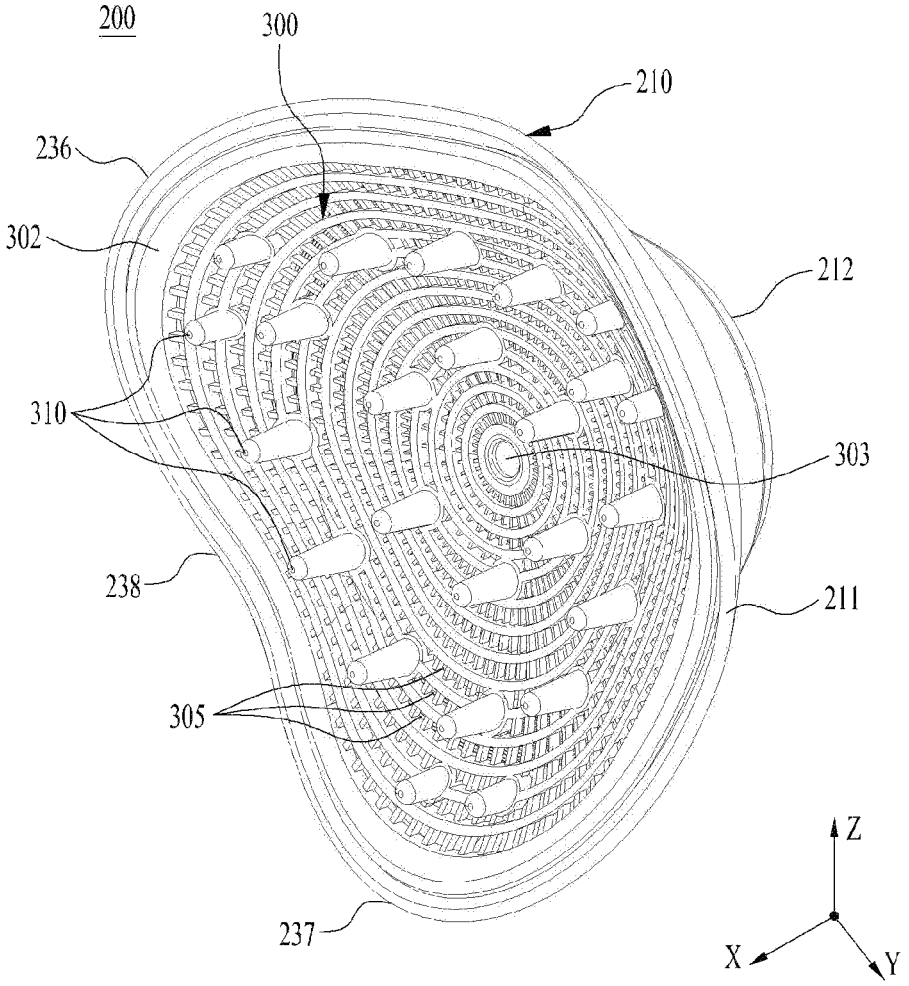
FIG. 5 is a view showing a diffuser according to an embodiment.

Referring to FIGS. 5 and 6, the diffuser 200 may be removably coupled to the main body 110 so that the gas discharged from the gas outlet 150 may be introduced into the diffuser 200 and to be discharged to the outside of the hair dryer 100. The diffuser 200 may alternatively be referred to as a head or nozzle head.

The diffuser 200 may be coupled to the main body 110 such that a rear side thereof covers the gas outlet 150, and the gas discharged from the gas outlet 150 may flow into the diffuser 200 through a gas inlet hole 215 defined at a rear side of the diffuser 200.

The user may selectively use the diffuser 200 for scalp or hair management. For example, the user may use a diffuser 200 including a massage protrusion or bristle 310 and a light irradiator or light 260, which will be described later, for scalp care. The user may also use the same diffuser 200 to dry hair, and a shape of the diffuser 200 may be configured such that a flow of a cross-sectional area of the gas is increased as needed in a hair drying step.

The rear side of the diffuser 200 may be coupled to the front end 112 of the main body 110. A first coupling portion or member 120 (FIG. 4) may be provided at the front end 112 of the main body 110, and a second coupling portion or member 220 configured to be coupled to the first coupling portion 120 may be provided at the rear side of the diffuser 200.

A coupling scheme between the diffuser 200 and the main body 110 may vary. The diffuser 200 may be coupled to the main body 110 in a scheme such as screw coupling, fitting coupling, magnetic coupling, or sliding coupling to receive the gas from the main body 110.

An embodiment of the present disclosure may improve ease of use of the user as the diffuser 200 is provided to be removable from the main body 110. For example, the user may remove the diffuser 200 when the user desires to use more concentrated gas discharged directly from the gas outlet 150 of the main body 110. Further, the user may add the diffuser 200 to the main body 110 when the user wants a more diffused or dispersed flow of gas.

The diffuser 200 may include a diffusing case 210 and a discharge or diffuser cover 300. The diffusing case 210 and a discharge cover 300 may form an exterior of the diffuser 200.

The diffuser may have a curved bell shape or hat shape. An inner diameter of the diffuser 200 may increase in a forward direction. An internal cross-sectional area of the diffusing case 210 and discharge cover 300 increases from a rear side or end 212 to a front side or rim 211.

Accordingly, gas delivered from the gas outlet 150 may be provided to the user in a state in which a flow cross-sectional area thereof is increased as the gas speed is reduced in the forward direction of the diffuser 200. The user may use the diffuser 200 for natural drying, styling, etc. for hair.

The front side 211 of the diffusing case 210 may be opened to define an open front surface. An entirety or a portion of the front surface of the diffusing case 210 may define the open surface. The gas present inside the diffuser 200 may be discharged to the outside through the open surface of the diffusing case 210 and be provided to the user while being discharged forward through the front side 211.

The open surface defined at the front side 211 of the diffusing case 210 may be exposed to the outside, or the discharge cover 300 may be provided to be coupled to the open surface.

FIG. 5 shows a state in which the discharge cover 300 is coupled to the open surface. The discharge cover 300 may include at least one gas discharge hole 305 defined therein through which the gas may be discharged. The discharge cover 300 may have a shape corresponding to the open surface of the diffusing case 210 and may be coupled to the diffusing case 210 to be located on or at the open surface.

A plurality of gas discharge holes 305 may be defined and may be spaced apart from each other in the front surface of the discharge cover 300. FIG. 5 shows a plurality of gas discharge holes 305 that are uniformly distributed and arranged in the front surface of the discharge cover 300. In such an arrangement, gas may be discharged through an entirety of the front surface of the discharge cover 300, and the user may receive gas that is discharged forward through the discharge cover 300 and more uniformly dispersed.

The discharge cover 300 may be provided such that an edge 302 located on the outermost side with respect to a radial direction of the diffuser 200 is in close contact with the diffusing case 210. The diffusing case 210 may have a front circumferential portion or rim 236 surrounding the open surface in the front side 211, and the edge 302 may have a shape corresponding to that of the front circumferential portion 236 and may be in contact with the front circumferential portion 236.

The front circumferential portion 236 may have a first portion 237 and a second portion 238. The first portion 237 and the second portion 238 may be arranged with different distances from the gas inlet hole 215 and/or rear side 212 of the diffusing case 210. The first and second portions 237 and 238 may represent various curves or waves defined by an outer edge of the diffusing case 210. The first portion 237 may be a hump or mountain and the second portion 238 may be a valley such the front circumferential portion 236 is further forward at the first portion 237 than at the second portion 238. The edge 302 of the discharge cover 300 may be molded to correspond to shapes of the first portion 237 and the second portion 238 so as to be in close contact with the front circumferential portion 236 of the diffusing case 210.

The front circumferential portion 236 of the diffusing case 210 and the edge 302 of the discharge cover 300 may be designed to fit over or on a head of the user with an arbitrary curved surface while respectively having curvatures and having different lengths protruding forward along an outer circumferential direction of the diffuser 200. Accordingly, a proximity or molding with the scalp or the hair of the user may be efficiently increased to minimize a space between the head of the user and the diffuser 200, thereby increasing a heating, drying, or treating effect. An amount of gas discharged forward through the discharge cover 300 and/or an amount or intensity of light provided by the light irradiator 260 may be efficiently increased.

An ergonomic design is made through the front circumferential portion 236 of the diffusing case 210 and the edge 302 of the discharge cover 300, which may be arranged to form curves when viewed from the side as described above and shown in the figures. In this case, the curvatures and the like of the front circumferential portion 236 and the edge 302 may be designed based on a standard head that is statistically determined.

For example, an embodiment of the present disclosure may define a R127 curvature design from a shape of the standard head, and design the shapes of the front circumferential portion 236 and the edge 302, and an overall shape of the diffusing case 210 and discharge cover 300, to correspond thereto.

In one example, a proximity or distance sensor 269 may be provided inside the diffusing case 210 to improve ease of use and efficiency of the diffuser 200. An open region or hole 303 may be defined in the discharge cover 300 such that a distance measurement accuracy of the proximity sensor 269 for a target in front of the diffuser 200 (e.g., the hair or the scalp of the user) may be improved. The proximity sensor 269 may be implemented in various schemes such as pressure, ultrasound, infrared, laser, light, etc. to measure a distance to the target in front of the proximity sensor 269, and a region of the discharge cover 300 in front of the proximity sensor 269 may be opened to define the open region 303.

In one example, FIG. 5 shows a discharge cover 300 having a plurality of massage protrusions or bristles 310. The massage protrusions 310 may have a pillar shape protruding forward from the diffuser 200 and may press the scalp of the user to provide a massage effect. A cross-sectional shape, a protruding length, an arrangement form, and the like of the massage protrusions 310 may be variously determined in terms of a design. An embodiment of the present disclosure provides the user with scalp massage through the massage protrusions 310 while also providing the gas diffused through a front surface of the discharge cover 300 to the user, thereby providing the improved ease of use and facilitating scalp and hair care.

Figure 7:
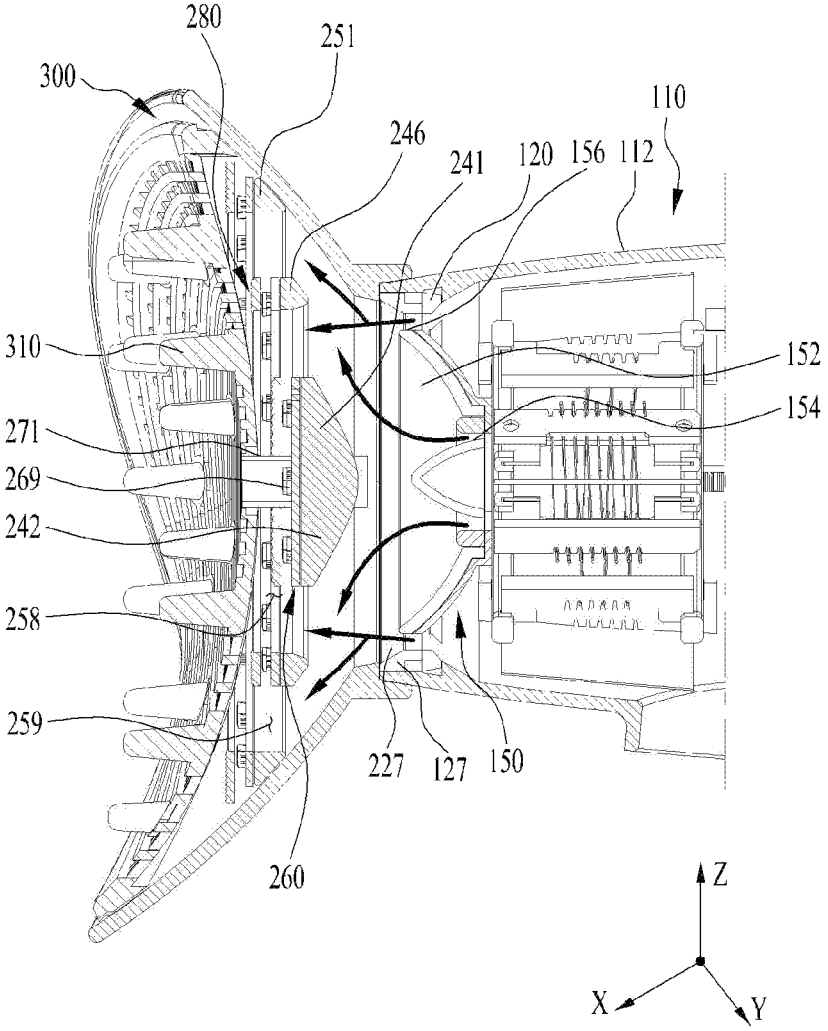
FIG. 7 is a view showing an internal cross-section of a diffuser according to an embodiment.

Referring to FIGS. 6 and 7, the diffuser 200 may include the diffusing case 210, a guide frame 240, the light irradiator 260, a light diffusion frame 280, and the discharge cover 300.

A rear side 212 of the diffusing case 210 may be coupled with the main body 110, and the open surface may be defined in the front side 211. The inner diameter of the diffusing case 210 may increase from the rear side 212 to the front side 211 so that the gas exiting the main body 110 may be diffused and discharged to the outside. The gas discharged through the gas outlet 150 of the main body 110 may be provided to the user in a state in which the flow cross-sectional area thereof is increased as the gas is flowing in the diffusing case 210.

FIGS. 6 and 7 show a diffusing case 210 in which the inner diameter thereof increases from the rear side 212 to the front side 211 and accordingly an outer diameter thereof increases in the same manner. The gas inlet hole 215 may be defined in the rear side 212 of the diffusing case 210. When the diffusing case 210 is coupled to the main body 110, the gas inlet hole 215 may be positioned to face, surround, or communicate with the gas outlet 150. Further, the gas discharged from the gas outlet 150 may be introduced into the diffusing case 210 through the gas inlet hole 215.

The gas inlet hole 215 may be located at a center of the rear side 212 of the diffusing case 210 when viewed from the rear, and a cross-sectional shape of the gas inlet hole 215 may correspond to that of the gas outlet 150. For example, the gas inlet hole 215 may be defined to have an inner diameter larger than that of the side opening 156 of the gas outlet 150, so that the gas discharged from the gas outlet 150 may be completely introduced into the diffusing case 210 through the gas inlet hole 215.

The second coupling portion 220 coupled to the main body 110 may be provided on the rear side 212 of the diffusing case 210. The diffusing case 210 may include a rear circumferential portion or body 217 surrounding the gas inlet hole 215 in the rear side 212, and the second coupling portion 220 may be provided at a rear end or side of the rear circumferential portion 217 surrounding the gas inlet hole 215.

The second coupling portion 220 may further include a coupling sleeve or flange 224. The coupling sleeve 224 may extend rearward from the rear of the rear circumferential portion 217. The coupling sleeve 224 may be provided to outwardly surround the front end 112 of the main body 110 when the diffuser 200 is coupled to the main body 110.

The first coupling portion 120 may be provided at the front end 112 of the main body 110 and may have a first magnetic fastening portion 127 (e.g., a magnet of a first polarity or a metal) embedded inside the outer wall of the front end 112 or located inside the outer wall. The first coupling portion 120 may further include a power transmitter or transceiver (e.g., a wireless power transceiver that works through electromagnetic induction) provided on an outer surface or a front surface of the outer wall of the front end 112.

The second coupling portion 220 may have a second magnetic fastening portion 227 (e.g., a magnet of a second polarity or a metal) embedded in the rear circumferential portion 217 or located inside the rear circumferential portion 217. The second coupling portion 220 may further include a power receiver or transceiver (e.g., a wireless power transceiver that works through electromagnetic induction) provided on or at an inner surface or rear surface of the coupling sleeve 224.

The first coupling portion 120 may be coupled to the second coupling portion 220. At least one of the first magnetic fastening portion 127 and the second magnetic fastening portion 227 may include a magnetic force generator (e.g., a ferromagnetic material or an electric current) so that the first magnetic fastening portion 127 and the second magnetic fastening portion 227 may be magnetically coupled to each other. The magnetic coupling means a scheme of mutual coupling through a magnetic force generated from the magnetic force generator, which may be implemented as a magnet and/or an electromagnet.

The power transmitter may supply power to the power receiver, which may be aligned, in contact with, or in connection with the power receiver when the diffuser 200 is coupled to the main body 110. The power receiver may be connected to components or devices of the diffuser 200 (e.g., the light irradiator 260, the proximity sensor 269, and the moisture measurement protrusion 312 described later) to supply power thereto.

The open surface surrounded by the front circumferential portion 236 may be defined in the front side 211 of the diffusing case 210, and the gas inside the diffusing case 210 may be discharged forward through the diffuser 200 through the open surface in the front side 211.

The guide frame 240 may be provided inside the diffusing case 210. The guide frame 240 may guide the flow of the gas introduced through the gas inlet hole 215.

The guide frame 240 may face the gas inlet hole 215 of the diffusing case 210. The guide frame 240 may have a diffusion portion or base 241 at a center thereof, a first guide or ring 246 provided radially outward of the diffusion portion 241, and a second guide or ring 251 provided radially outward of the first guide 246. The guide frame 240 may include a guide connector or tab 253 extending along the radial direction of the diffuser 200 to connect the diffusion portion 241, the first guide 246, and the second guide 251 to each other.

The diffusion portion 241 of the guide frame 240 may face the gas inlet hole 215 to diffuse the gas introduced through the gas inlet hole 215 outward in the radial direction. The flow cross-sectional area of the gas introduced through the gas inlet hole 215 may be increased by the diffusion portion 241.

A flow direction of the gas discharged from the center opening 154 may be changed by the diffusion portion 241. The diffusion portion 241 may have a larger diameter than the center opening 154, and diffuse the gas provided from the center opening 154 outward in the radial direction.

The first guide 246 may have a ring shape, and the diffusion portion 241 may be located at a center of the first guide 246. The diffusion portion 241 may have a circular cross-section, and may be outwardly spaced apart from the diffusion portion 241 while being concentric with the diffusion portion 241 of the first guide 246.

A first flow path or opening 258 may be provided between the first guide 246 and the diffusion portion 241. The first guide 246 may be spaced apart from the diffusion portion 241 to define the first flow path 258 between the first guide 246 and the diffusion portion 241. The gas diffused through the diffusion portion 241 may flow through the first flow path 258.

The second guide 251 may have a ring shape corresponding to the ring shape of the first guide 246, and the diffusion portion 241 and the first guide 246 may be located at a center of the second guide 251. The second guide 251 may be concentric with the diffusion portion 241 and the first guide 246 and may be spaced apart from the first guide 246.

An inner diameter of the first guide 246 may be larger than the diameter of the diffusion portion 241, and an inner diameter of the second guide 251 may be larger than an outer diameter of the first guide 246. Accordingly, the first flow path 258 may be defined between the diffusion portion 241 and the first guide 246, and a second flow path or opening 259 may be defined between the first guide 246 and the second guide 251.

The gas diffused by the diffusion portion 241 may flow through the first flow path 258 and the second flow path 259. An outer diameter of the second flow path 259 may be larger than the diameter of the gas inlet hole 215, so that the gas introduced through the gas inlet hole 215 may be diffused by the diffusion portion 241 and flow with a larger flow cross-section.

The light irradiator 260 may be located in front of the guide frame 240 and installed on a front surface of the guide frame 240. The light irradiator 260 may have a plurality of light emitters 262 (e.g., light emitting diodes or LEDs) arranged on a circuit board 265. The circuit board 265 may include a plurality of circuit boards separated from each other, and the plurality of boards of the circuit board 265 may have a size, shape and arrangement corresponding to that of the diffusion portion 241, the first guide 246, and the second guide 251 of the guide frame 240. The circuit board 265 may not interfere with gas or air flowing through the first and second flow paths 258 and 259.

The plurality of circuit boards 265 may respectively include a central board or base 266, a first board or ring 267, and a second board or ring 268. The central board 266 may have a cross-sectional shape corresponding to the diffusion portion 241. For example, the diffusion portion 241 may have the circular cross-section, and the central board 266 may have a circular cross-section in the same manner as the diffusion portion 241. The central board 266 may be provided on or at a front surface of the diffusion portion 241 and may include a plurality of light emitters 262.

The first board 267 may have a shape corresponding to the first guide 246. For example, the first guide 246 may have a ring shape, and the first board 267 may have a ring shape in the same manner as the first guide 246. The first board 267 be provided on or at a front surface of the first guide 246 and may include a plurality of light emitters 262.

The second board 268 may have a shape corresponding to the second guide 251. For example, the second guide 251 may have a ring shape, and the second board 268 may have a ring shape in the same manner as the second guide 251. The second board 268 may be provided on or at a front surface of the second guide 251 and may include a plurality of light emitters 262.

The central board 266, the first board 267, and the second board 268 may be arranged to be concentric like the diffusion portion 241, first guide 246, and second guide 251 of the guide frame 240. The first board 267 may be outwardly or radially spaced apart from the central board 266, and the second board 268 may be outwardly or radially spaced apart from the first board 267. An inner diameter of the first board 267 may be larger than a diameter of the central board 266, and an inner diameter of the second board 268 may be larger than an outer diameter of the first board 267. Like the guide frame 240, the first flow path 258 may be located between the central board 266 and the first board 267, and the second flow path 259 may be located between the first board 267 and the second board 268.

A position of the light irradiator 260 may be secured by a coupling between the light diffusion frame 280 and the guide frame 240, which will be described later. Alternatively, the central board 266, the first board 267, and the second board 268 may be optionally coupled (e.g., adhered, welded, or pressed-fit) to front surfaces of the diffusion portion 241, the first guide 246, and the second guide 251, respectively. The circuit board 265 may include optional tabs or connectors corresponding to the guide connectors 253 to connect the central board 266, the first board 267, and the second board 268 to each other. When such optional connectors are included, the optional connectors may be coupled to (e.g., adhered, welded, or pressed-fit) to the guide connectors 254 of the guide frame 140 and/or light diffusion connectors 288 of the light diffusion frame 280 described later. As another alternative, when such optional connectors are included, the circuit board 265 may be coupled to just one or two of the front surfaces of the diffusion portion 241, the first guide 246, and the second guide 251. For example, the central board 266 may be secured to the diffusion portion 241, while the first and second boards 267 and 268 merely contact and/or are merely positioned to align with the first guide 246, and the second guide 251, respectively.

The light irradiator 260 may irradiate light toward the front side 211 of the diffusing case 210 through the plurality of light emitters 262. The light irradiated from the light irradiator 260 may be emitted toward a location ahead or forward of the diffuser 200 through the front side 211 of the diffusing case 210.

For example, the light irradiated from the light irradiator 260 may pass through the open surface of the diffusing case 210 and through the gas discharge holes 305 of the discharge cover 300, through the massage protrusion 310 of the discharge cover 300, or, if the discharge cover 300 is made of a transparent or translucent material, through a main body or portion the discharge cover 300.

As the light is irradiated forward from the diffuser 200, the diffuser 200 may treat a user's hair or scalp care. The light irradiated from the light irradiator 260 may contribute to improving scalp and hair health while drying the user's scalp or hair or while providing heat to the user's scalp or hair. The wavelength of the light irradiated from the light emitter 262 may be predetermined or may be selected by the user. For example, red light (620-660 nm) may be used to prevent hair loss or increase blood flow to the scalp, or UV light (100-400 nm) may be used to sanitize the scalp or treat skin conditions such as scalp psoriasis.

The proximity sensor 269 may be provided on the circuit board 265 of the light irradiator 260. FIG. 6 shows a state in which the proximity sensor 269 is provided on the central board 266 of the light irradiator 260.

The proximity sensor 269 may be provided at a center of the central board 266. The proximity sensor 269 may be provided to measure a separation distance from the target positioned in front of the proximity sensor 269. The controller 115 may be provided to control the light irradiator 260 based on the separation distance between the proximity sensor 269 and the target measured by the proximity sensor 269.

For example, when the separation distance from the target measured by the proximity sensor 269 is equal to or less than a reference or predetermined distance, the controller 115 may control the light irradiator 260 such that the light irradiator 260 irradiates the light forward via the light emitters 262. The reference distance may be predetermined in terms of a design or control. The light irradiator 260 may also be operated through a physical switch, which may be operated even when the separation distance measured by the proximity sensor 269 is equal to or less than the reference distance. As the proximity sensor 269 is used, the light irradiator 260 may be operated when the separation distance from the target in front of the diffuser 200 (i.e., the scalp or the hair of the user) is equal to or less than the reference distance, thereby improving ease of use and an operation efficiency.

The proximity sensor 269 may be provided in various types. For example, the proximity sensor 269 may be a pressure sensor that detects whether a pressing force is applied from the user's scalp or hair, or a photosensitive sensor that measures a level at which an amount of sensed light decreases as the separation distance from the scalp or the hair decreases.

In addition, the proximity sensor 269 may be an infrared (IR) sensor that measures an infrared ray transmitted from the target to measure the separation distance from the scalp or the hair. In this case, the proximity sensor 269 may be provided to irradiate the infrared ray forward.

The light diffusion frame 280 may be located in front of the light irradiator 260. The light diffusion frame 280 may be installed on a front surface of the light irradiator 260 to forwardly cover the light emitters 262 of the light irradiator 260.

The light diffusion frame 280 may include a central light diffusion portion or diffuser 282, a first light diffusion portion or diffuser 284 and a second light diffusion portion or diffuser 286. The light diffusion frame 280 may further include a light diffusion connector 288 to connect the central light diffusion portion 282, the first light diffusion portion 284, and the second light diffusion portion 286 to each other.

The central light diffusion portion 282 may have a cross-sectional shape corresponding to that of the central board 266. For example, the central board 266 may have a circular cross-section, and the central light diffusion portion 282 may have a circular cross-section in the same manner as the central board 266 and may cover the front surface of the diffusion portion 241.

The first light diffusion portion 284 may have a shape corresponding to the first board 267. For example, the first board 267 may have the previously described ring shape, and the first light diffusion portion 284 may have a ring shape in the same manner as the first board 267 and may cover the front surface of the first board 267.

The second light diffusion portion 286 may have a shape corresponding to the second board 268. For example, the second board 268 may have the previously described ring shape, and the second light diffusion portion 286 may have a ring shape in the same manner as the second board 268 and may cover the front surface of the second board 268.

The central light diffusion portion 282, the first light diffusion portion 284, and the second light diffusion portion 286 may be arranged to be concentric like the arrangement of the guide frame 240 and the light irradiator 260. The first light diffusion portion 284 may be outwardly spaced apart from the central light diffusion portion 282, and the second light diffusion portion 286 may be outwardly spaced apart from the first light diffusion portion 284 so as not to block a flow of discharged air or gas.

An inner diameter of the first light diffusion portion 284 may be larger than a diameter of the central light diffusion portion 282, and an inner diameter of the second light diffusion portion 286 may be larger than an outer diameter of the first light diffusion portion 284. Like the guide frame 240, the first flow path 258 may be located between the central light diffusion portion 282 and the first light diffusion portion 284, and the second flow path 259 may be located between the first light diffusion portion 284 and the second light diffusion portion 286.

The diffuser 200 may be provided in a shape in which the first flow path 258 and the second flow path 259 are extended in the front and rear directions through the guide frame 240, the light irradiator 260, and the light diffusion frame 280. The light diffusion connector 288 may be provided in a shape corresponding to the guide connector 253. For example, the guide connector 253 and the light diffusion connector 288 may have an extended shape along the radial direction of the diffuser 200.

The light diffusion connector 288 may be located in front of and aligned with the guide connector 253 so as not to block a flow of discharged air or gas. The light diffusion frame 280 may be fixed inside the diffusing case 210 as the light diffusion frame 280 is fastened to the guide connector 253.

An embodiment of the present disclosure is advantageous in terms of a design and structurally stable in that, in a state in which the guide frame 240 is constituted by a plurality of components, the plurality of components may be able to be handled as a single component through the guide connector 253. In addition, an embodiment of the present disclosure is advantageous in terms of the design and structurally stability in that, in a state in which the light diffusion frame 280 is constituted by a plurality of components, the plurality of components are able to be handled as a single component through the light diffusion connector 288.

Furthermore, the light diffusion connector 288 of the light diffusion frame 280 may be coupled to the guide connector 253 of the guide frame 240, so that all of the central light diffusion portion 282, the first light diffusion portion 284, and the second light diffusion portion 286 may be stably fixed and secure, which is advantageous in terms of coupling.

The light diffusion frame 280 may be made of a material through which light is transmitted (i.e., a transparent or translucent material, such as plastic or glass). The light irradiated from the light irradiator 260 may be scattered and diffused while passing through the light diffusion frame 280. The light diffusion frame 280 may be provided in front of the light irradiator 260 so that the light irradiated from the light irradiator 260 may be provided to the user while being scattered and diffused and being uniformly dispersed in a larger area.

A treatment for the diffusion or the scattering of the light may be performed on a front surface or a rear surface of the light diffusion frame 280. For example, etching may be performed or a pattern through laser processing and the like may be formed on a surface of the light diffusion frame 280.

In one example, the central light diffusion portion 282 may shield the front surface of the central board 266, and a portion of the central light diffusion portion 282 in front of the proximity sensor 269 may be opened or formed with a hole such that the measurement of the separation distance from the target in front of the diffuser 200 via the proximity sensor 269 may be convenient or undisturbed. When the proximity sensor 269 is provided at the center of the central board 266, the central light diffusion portion 282 may have a hole defined at a center thereof (as shown in the figures) to expose the proximity sensor 269 forwardly and allow transmission of a signal to or from the proximity sensor 269.

The discharge cover 300 may shield the open surface defined in the front side 211 of the diffusing case 210 in which the guide frame 240, the light irradiator 260, and the light diffusion frame 280 may be embedded. The plurality of gas discharge holes 305 may be defined in the discharge cover 300 so that gas may be discharged and the light may be irradiated forward.

The edge 302 of the discharge cover 300 may have a curvature configured to correspond to that of the front circumferential portion 236 of the diffusing case 210 when viewed from the side. A front surface of the discharge cover 300 may form a curved surface that is indented or recessed rearwards centerwardly so that the discharge cover 300 may have a shape corresponding to the head of the user, which may facilitate a massage effect through the massage protrusions 310 while providing the gas or air and the light to the user.

The plurality of massage protrusions 310 may each have a contact portion provided on a front surface or end thereof. The contact portions of the plurality of massage protrusions 310 may be configured such that a sense of touch with the scalp or the hair of the user may be improved and damage to the scalp and the hair may be minimized. For example, the contact portion may be made of an elastic or soft material such as silicon, rubber, or plastic.

The discharge cover 300 may also include at least one moisture measurement protrusion or sensor 312, which may also serve as a massage protrusion 310. The moisture measurement protrusion 312 may be provided to measure a moisture amount of the scalp or the hair of the user. A pair of moisture measurement protrusions 312 may be arranged to measure an impedance, such as a bioelectrical impedance through an electric field formed therebetween.

The moisture measurement protrusions 312 may be connected to the controller 115. The controller 115 may determine the impedance using a voltage, a current, a resistance, and the like, which are identified through the moisture measurement protrusion 312, and determine the moisture amount of the scalp or the hair of the user based on the determined impedance. The controller 115 may further control an operation of the fan 119, the temperature adjuster 117, or the light irradiator 260 based on the determined moisture amount.

For example, the controller 115 may control the fan 119 to increase a rotation speed (such that the speed of discharged gas increases) as the determined moisture amount of the scalp or the hair of the user increases. Alternatively or in addition thereto, the controller 115 may control the temperature adjuster 117 such that a temperature of the discharged gas increases and/or control the light irradiator 260 such that a light amount or intensity increases as the determined moisture amount of the scalp or the hair of the user increases. A light amount or intensity may be increased by increasing a number of light emitters 262 emitting light and/or increasing an intensity of light emitted by each light emitter 262.

A pair of moisture measurement protrusions 312 may include a first moisture measurement protrusion 315 electrically having a first pole and a second moisture measurement protrusion 316 having a second pole opposite to the first pole. The controller 115 may determine the impedance and the moisture amount through the electric field formed between the first moisture measurement protrusion 315 and the second moisture measurement protrusion 316.

A plurality of pairs of moisture measurement protrusions 312, each of which includes the first moisture measurement protrusion 315 and the second moisture measurement protrusion 316, may be arranged. One pair of moisture measurement protrusions 312 may be provided to be spaced apart from another pair of moisture measurement protrusions 312, and different massage protrusions 310 may be positioned therebetween.

In one example, the open region 303 may be defined at a center of the discharge cover 300. The proximity sensor 269 may be exposed forward through the hole defined in the light diffusion frame 280 and the open region 303 of the discharge cover 300, and may measure the separation distance from the target in front of the diffuser 200. A protection member (e.g., a transparent film or layer) that protects the proximity sensor 269 and allows the infrared ray or the like to pass straight therethrough may be provided in front of the proximity sensor 269 (e.g., in a center hole of the light diffusion frame or in the open region 303).

Referring to FIG. 7, the first coupling portion 120 of the main body 110 may include the first magnetic fastening portion 127, and the second coupling portion 220 of the diffuser 200 may include the second magnetic fastening portion 227. The diffuser 200 may be coupled to the front end 112 of the main body 110 through a magnetic coupling or interaction between the first magnetic fastening portion 127 and the second magnetic fastening portion 227. The first coupling portion 120 may further include a hook fastener or loop, and the second coupling portion 220 may further include a hook configured to be fastened to the hook fastener so that a coupling stability between the diffuser 200 and the main body 110 may be enhanced.

Hereinafter, a flow of the gas discharged from the gas outlet 150 according to an embodiment of the present disclosure will be described with reference to FIG. 7. In the gas outlet 150, the gas is discharged from the center opening 154 and the side opening 156. The gas inlet hole 215 of the diffusing case 210 may have a diameter equal to or larger than that of the side opening 156 and face the gas outlet 150 so that the gas discharged from the center opening 154 and the side opening 156 may be introduced into the inlet hole 215.

The guide frame 240 may be provided inside the diffusing case 210 to face the gas outlet 150. The diffusion portion 241 of the guide frame 240 may be positioned to face the center opening 154 of the gas outlet 150.

The gas discharged from the center opening 154 may flow toward the diffusion portion 241. As the diffusion portion 241 has a diameter larger than that of the center opening 154, the gas discharged from the center opening 154 may be diffused outward along the radial direction of the diffuser 200.

The diffusion portion 241 may have a diffusion protrusion or cone 242 on a rear surface thereof facing the center opening 154. The diffusion protrusion 242 may have a curvature such that a diameter thereof decreases in a rearward direction to protrude or point toward the gas outlet 160. The diameter of the diffusion protrusion 242 may decrease toward a center, which may face the gas outlet 160. A diffusion effect of the gas discharged from the center opening 154 may be improved by the diffusion protrusion 242.

At least a portion of the gas discharged from the center opening 154 may flow along the first flow path 258 defined between the diffusion portion 241 and the first guide 246 in the guide frame 240 by the diffusion portion 241 and the diffusion protrusion 242. In one example, the gas discharged from the side opening 156 may flow outward to surround the gas discharged from the center opening 154, and the gas discharged from the side opening 156 may also diffuse outward along the radial direction of the diffuser 200 as the gas of the center opening 154 is diffused by the diffusion portion 241. At least a portion of the gas discharged from the side opening 156 and at least a portion of the gas discharged from the center opening 154 may flow along the second flow path 259 defined between the first guide 246 and the second guide 251 in the guide frame 240.

Despite a design feature where the inner diameter of the diffuser 200 may increase in a forward direction, the discharging of the gas through the center opening 154 and the side opening 156 in the forward direction while being maintained in a specific form may be effectively suppressed through the guide frame 240. The diffuser 200 may allow the gas discharged from the center opening 154 and the side opening 156 to be effectively dispersed and diffused with a larger flow cross-sectional area while preventing the flow of the gas from being maintained in the specific form.

In one example, the light irradiator 260 and the light diffusion frame 280 may be arranged in front of the guide frame 240 inside the diffusing case 210. The light irradiator 260 and the light diffusion frame 280 may be coupled with the guide frame 240 and may be handled as a single component, improving space utilization, convenience, security, and design.

The light irradiator 260 and the light diffusion frame 280 may define the first flow path 258 and the second flow path 259 together with the guide frame 240. The flow of the gas formed by the guide frame 240 may be effectively maintained, and the gas may be discharged forward from the diffuser 200 through the light irradiator 260 and the light diffusion frame 280.

In the light irradiator 260, the first board 267 may be positioned to be forward or in front of of the central board 266, and the second board 268 may be positioned to be forward or in front of the first board 267. The plurality of light emitters 262 arranged in the light irradiator 260 may be arranged to form a spherical or curved surface that is indented or recessed rearward. The plurality of light emitters 262 may be arranged in a form in which a distance from a center of the light irradiator 260 along the radial direction increases forwardly. Such arrangement of the light emitters 262 may correspond to the shape of the front surface of the discharge cover 300 indented rearward. The plurality of light emitters 262 arranged on the light irradiator 260 may be arranged to form the curved surface to correspond to the user's head having a curvature, so that a uniform amount of light may be provided to the user's scalp and hair.

Like the light irradiator 260, the guide frame 240 may be provided such that the first guide 246 may be positioned forward or in front of the diffusion portion 241, and the second guide 251 may be positioned forward or in front of the first guide 246. The first board 267 provided on the front surface of the first guide 246 may be positioned forward or in front of the central board 266 provided at the front surface of the diffusion portion 241, and the second board 268 provided at the front surface of the second guide 251 may be positioned forward or in front of the first board 267.

Like the light irradiator 260, in the light diffusion frame 280, the first light diffusion portion 284 may be positioned forward or in front of the central light diffusion portion 282, and the second light diffusion portion 286 may be positioned forward or in front of the first light diffusion portion 284. A distance between the light diffusion frame 280 and the light irradiator 260 may be kept constant, and uniform dispersion and scattering of the light may be induced. In the guide frame 240, as the second guide 251 may be positioned forward of the first guide 246 and the first guide 246 may be positioned forward of the diffusion portion 241, a space in which the gas introduced from the gas inlet hole 215 is diffused in the radial direction may be secured, and the gas may be smoothly introduced into the first flow path 258 and the second flow path 259.

FIG. 7 shows the guide frame 240, the light irradiator 260, and the light diffusion frame 280 protruding forward in a direction away from centers thereof.

FIG. 7 also shows a light blocking portion or shield 271 surrounding the proximity sensor 269. The light blocking portion 271 may have a hollow cylindrical shape, but embodiments disclosed herein are not limited. The light blocking portion 271 may be provided to surround the proximity sensor 269 along a circumferential direction of the diffuser 200, preventing a situation in which the light emitter 262 around the proximity sensor 269 affects a measurement the proximity sensor 269. The proximity sensor 269 may be located inside the light blocking portion 271. The light blocking portion 271 may have a shape extending from the central board 266 to the discharge cover 300.

The light blocking portion 271 may be opened in a forward direction to prevent structural interference from occurring in a measurement of the separation distance between the diffuser 200 and the front target by the proximity sensor 269. For example, when the proximity sensor 269 measures an infrared ray transmitted from the target, the light blocking portion 271 may have a front opening to allow the infrared ray transmitted from the target to be completely provided to the proximity sensor 269.

The light blocking portion 271 may be provided to extend rearward from the discharge cover 300, or may be formed integrally with the discharge cover 300 or integrally with the central board 266. The light blocking portion 271 may be manufactured separately from the discharge cover 300 and the central board 266, and may be later coupled to or combined with the discharge cover 300 and/or the central board 266.

The hair dryer 100 may include the main body 110, the handle 180, and the diffuser 200, and the diffuser 200 may include the diffusing case 210 and the discharge cover 300.

Figure 8:
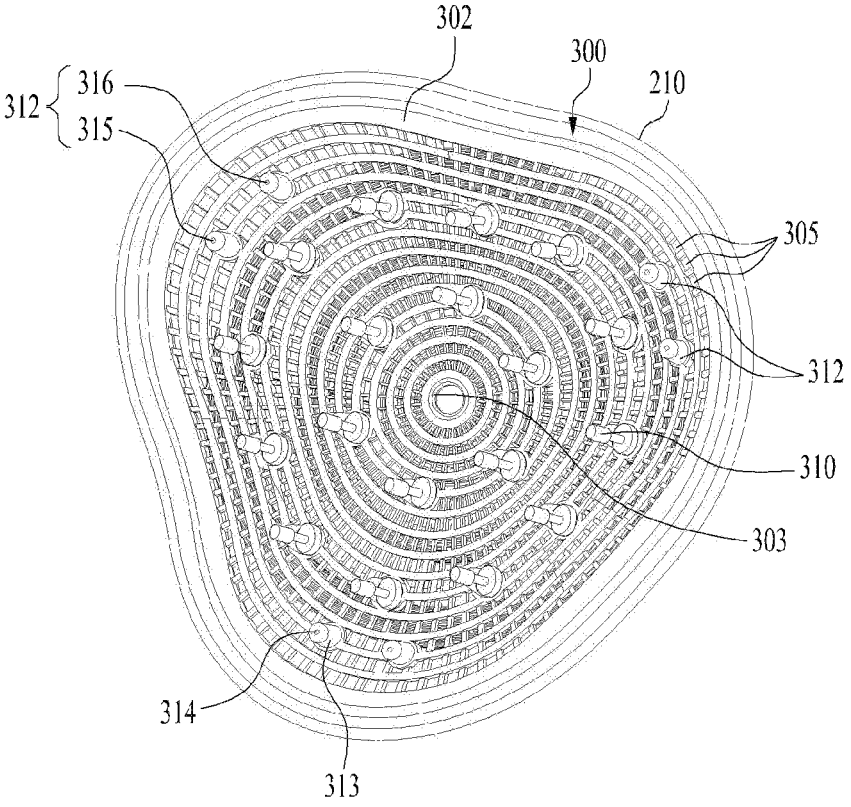
FIG. 8 is a view showing a diffuser according to an embodiment viewed from the front.

Referring to FIG. 8, the discharge cover 300 may include the plurality of massage protrusions 310. The plurality of massage protrusions 310 may protrude forward to press the target located in front of the discharge cover 300. In addition, the plurality of massage protrusions 310 may include the moisture measurement protrusion 312. The moisture measurement protrusion 312 may be provided to measure the moisture amount of the target.

The massage protrusion 310 may be provided on the discharge cover 300, and may include the plurality of massage protrusions to press the front target, for example, the scalp, the hair, or the like of the user. The massage protrusion 310 may have a shape of a protrusion or pillar protruding forward from the discharge cover 300, and a shape of a cross-section thereof may be various, such as circular or polygonal. A protrusion length of the massage protrusion 310 may vary in design.

For example, the plurality of massage protrusions 310 arranged on the discharge cover 300 may have the same protrusion length in an entire range of the discharge cover 300. Alternatively, a massage protrusion 310 provided in a specific region may have a larger or shorter protrusion length than a massage protrusion 310 provided in a remaining region.

The massage protrusion 310 may further include an optional contact cover or pad 317 (FIG. 6, FIG. 11) forming a front circumferential or end surface of the massage protrusion 310 to minimize damage to the user's scalp and hair. The contact cover 317 may be made of a material, such as silicone, that may minimize the damage to the scalp and hair due to friction and the like. The contact cover 317 may optionally be formed of a light transmissive material when the light emitters 262 are arranged to align with the massage protrusions 310.

FIG. 8 shows the plurality of massage protrusions 310 uniformly distributed throughout the front surface of the discharge cover 300 according to an embodiment. In one example, some of the plurality of massage protrusions 310 may correspond to the moisture measurement protrusions 312. The plurality of massage protrusions 310 may include the moisture measurement protrusions 312. The moisture measurement protrusion 312 may be provided to measure the moisture amount of the target.

The moisture measurement protrusions 312 corresponding to some of the plurality of massage protrusions 310 may be arranged to press the user's scalp and hair in the same manner as the massage protrusions 310 that are not moisture measurement protrusions 312. The moisture measurement protrusion 312 may be provided to measure an amount of moisture present in the scalp.

A moisture measurement scheme of the moisture measurement protrusion 312 may be various. For example, the moisture measurement protrusion 312 may be provided to form an electric field to measure a bioelectrical impedance. A measurement scheme of the bioelectrical impedance in the present disclosure is as follows.

When the moisture measurement protrusion 312 measures the moisture amount of the scalp, a voltage may be formed at the moisture measurement protrusion 312, and an electric field may be formed by electrical polarity generation resulted from the voltage. For example, the moisture measurement protrusion 312 may come in pair to have first and second moisture measurement protrusions 315 and 316, which may have opposite polarities so as to produce an electric field therebetween.

The electric field may be changed by an amount of moisture present in the scalp. For example, as the moisture amount of the scalp increases, the electric field may be amplified. Accordingly, an impedance value determined from the electric field may be reduced. Conversely, when a moisture amount of the scalp is small, the electric field formed by the moisture measurement protrusion 312 may be reduced, and thus an impedance value on the scalp may be measured as a large value.

As described above, the moisture measurement protrusion 312 may be provided to measure the moisture amount of the scalp based on the change in the bioelectrical impedance. However, the moisture amount measurement scheme of the moisture measurement protrusion 312 according to an embodiment may not be necessarily limited as described above, and may include various schemes such as an electroosmosis scheme, an electronic sensor scheme, etc.

The diffuser 200 may efficiently measure the moisture amount of the user's scalp or hair as some of the plurality of massage protrusions 310 are arranged as the moisture measurement protrusions 312. The hair dryer 100 according to an embodiment may be advantageous because a result of the moisture amount measurement of the diffuser 200 may be used in the care of the user's scalp and hair.

Figure 9:
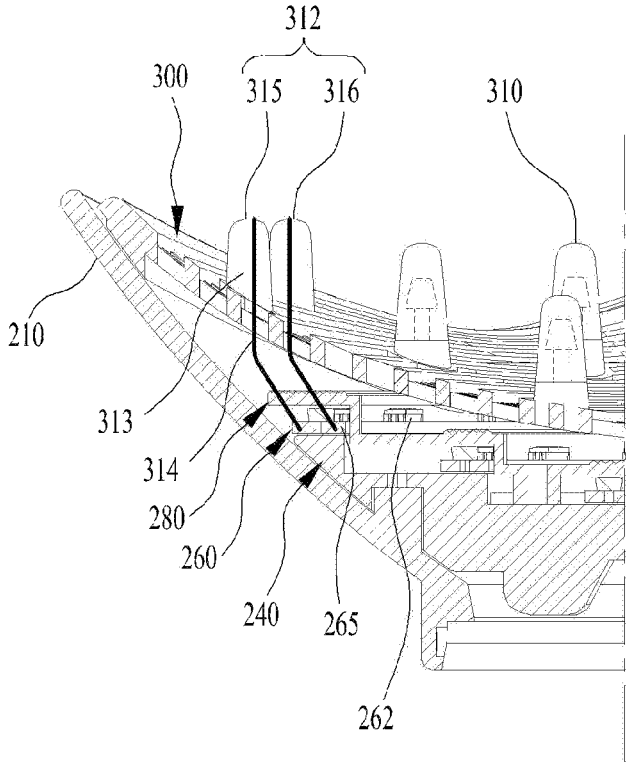
FIG. 9 is a view showing a moisture measurement protrusion connected to a light irradiator in a diffuser according to an embodiment.

In one example, FIG. 9 shows the moisture measurement protrusion 312 connected to the light irradiator 260 according to an embodiment. Referring to FIGS. 8 and 9, the moisture measurement protrusion 312 may include a protrusion base 313 and a moisture measurement electrode 314.

The protrusion base 313 may be provided to protrude forward to press the target. The moisture measurement electrode 314 may be provided in the protrusion base 313, at least a portion of the moisture measurement electrode 314 may be exposed to an outside from the protrusion base 313. The moisture measurement electrode 314 may have an electrical polarity by the voltage.

The protrusion base 313 may have a shape of a protrusion protruding forward from the front surface of the discharge cover 300. The protrusion base 313 may be included not only in the moisture measurement protrusion 312, but other massage protrusions 310 that are not moisture measurement protrusions 312. The moisture measurement protrusion 312 may be structurally the same as or similar to the others of the massage protrusions 310 except for the moisture measurement electrode 314.

The protrusion base 313 may protrude forward of the discharge cover 300 such that a front end thereof may press the user's scalp. The user may massage the scalp using the protrusion base 313 of the massage protrusion 310.

The moisture measurement electrode 314 may contain a conductive material such as copper. Because the moisture measurement electrode 314 is made of the conductive material, the moisture measurement electrode 314 may be electrically, for example, positively or negatively charged when the voltage is provided.

The moisture measurement electrode 314 may be provided in the protrusion base 313. At least a portion of the moisture measurement electrode 314 may be exposed from the protrusion base 313 so as to be adjacent to or in contact with the scalp, hair, etc. of the user. A portion of the moisture measurement electrode 314 may be provided inside the protrusion base 313, or an entirety of the moisture measurement electrode 314 may be provided on a surface of the protrusion base 313 to be exposed. Embodiments disclosed herein are not limited. As shown in the figures, the moisture measurement electrode 314 may extend rearward to penetrate the protrusion base 313 and be exposed to an outside through a front end of the protrusion base 313. The optional contact cover 317 may be omitted from the moisture measurement protrusions 312 so as to facilitate amplification of the electric field.

FIGS. 8 and 9 show the moisture measurement protrusion 312 having the moisture measurement electrode 314 exposed at a front of the protrusion base 313 according to an embodiment. At the moisture measurement protrusion 312, the electrical polarity is generated at an exposed portion of the moisture measurement electrode 314 to generate an electric field at the scalp of the user. The electrical polarity may be either positive or negative.

FIG. 9 shows the moisture measurement electrode 314 penetrating the protrusion base 313 along a longitudinal direction of the protrusion base 313 according to an embodiment. The moisture measurement electrode 314 may be made of the conductive material such as copper, and damage of the moisture measurement electrode 314 resulted from external contact and the like may easily occur. Therefore, as shown in the figures, the moisture measurement electrode 314 may be provided inside the protrusion base 313 and may not protrude forward to stick out from the protrusion base 313.

The moisture measurement electrode 314 may be extend along the longitudinal direction of the protrusion base 313 to penetrate the interior of the protrusion base 313. The moisture measurement electrode 314 penetrating the protrusion base 313 may be exposed to an outside through a protruding end (or front end) of the protrusion base 313.

As the protruding end of the protrusion base 313 may be in contact with the user's scalp, etc. and the moisture measurement electrode 314 may be exposed at the end of the protrusion base 313, the moisture measurement electrode 314 may be in contact with or located adjacent to the user's scalp, which may be advantageous to form the electric field. As the moisture measurement electrode 314 may be embedded or provided inside the protrusion base 313, damage or cutting of the moisture measurement electrode 314 due to contact may be effectively prevented.

In one example, the moisture measurement protrusion 312 may include a plurality of moisture measurement protrusions 312. In addition, the plurality of moisture measurement protrusions 312 may include a first moisture measurement protrusion 315 and a second moisture measurement protrusion 316.

The first moisture measurement protrusion 315 may include a moisture measurement electrode 314 having a first pole, and the second moisture measurement protrusion 316 may include a moisture measurement electrode 314 having a second pole opposite to the first pole. In the plurality of massage protrusions 310, the first moisture measurement protrusion 315 and the second moisture measurement protrusion 316 may be arranged adjacent to each other.

FIG. 8 shows the first moisture measurement protrusion 315 and the second moisture measurement protrusion 316 arranged to be adjacent to each other among the plurality of massage protrusions 310. The first moisture measurement protrusion 315 and the second moisture measurement protrusion 316 may be difficult to be distinguished from each other in terms of an exterior appearance, but may be distinguished from each other with respect to a difference in electrical polarity.

The first moisture measurement protrusion 315 may include a moisture measurement electrode 314 charged to have the first pole. As an example, the first pole may be an anode or a cathode. The second moisture measurement protrusion 316 may include a moisture measurement electrode 314 charged to have the second pole. The second pole corresponds to the polarity opposite to the first pole. For example, when the first pole is the anode, the second pole may be the cathode, and when the first pole is the cathode, the second pole may be the anode.

As described above, the first moisture measurement protrusions 315 and the second moisture measurement protrusions 316 having opposite electrical polarities may form an electric field by interaction. That is, the electric field may be formed between the first moisture measurement protrusion 315 and the second moisture measurement protrusion 316.

The first moisture measurement protrusion 315 and the second moisture measurement protrusion 316 may be separated from each other, so that the moisture measurement electrode 314 of the first pole and the moisture measurement electrode of the second pole 314 may be effectively and stably separated from each other.

In addition, because the first moisture measurement protrusion 315 and the second moisture measurement protrusion 316 are arranged to be adjacent to each other, the electric field by the first moisture measurement protrusion 315 and the second moisture measurement protrusion 316 may be easily generated.

In one example, FIG. 8 shows a state in which a plurality of pairs of moisture measurement protrusions 312 are arranged, wherein each pair of moisture measurement protrusions 312 is constituted by the first moisture measurement protrusion 315 and the second moisture measurement protrusion 316 are arranged.

The massage protrusions 310 may be spaced apart from each other over an entire area of the discharge cover 300, and the scalp or the hair of the user may have a different moisture amount for each portion thereof. For example, even when the moisture amount is relatively high in a specific region, the moisture amount may be low overall in the remaining regions other than the specific region.

The scalp and the hair of the user may have a different moisture amount for each portion thereof. Even when the moisture amount measured by the moisture measurement protrusion 312 in a specific region may be high, the user's scalp or hair may be relatively dry overall.

When a moisture amount measured by a pair of moisture measurement protrusions 312 is different from a moisture amount measured by another pair of moisture measurement protrusions 312, the controller 115 may be able to determine an overall moisture amount by averaging moisture amounts by each pair of moisture measurement protrusions 312. The controller 115 may be capable of controlling multiple components based on an overall moisture amount calculated or based on a result required by the user.

The plurality of pairs of moisture measurement protrusions 312 may be arranged to measure moisture amounts at different areas of the user's head. The pairs of moisture measurement protrusions 312 may be arranged to be spaced apart from each other. At least one general or non-moisture sensing massage protrusion 310 may be provided between one pair of moisture measurement protrusions 312 and another pair of moisture measurement protrusions 312.

FIG. 8 shows that a front surface region of the discharge cover 300 may be divided into three regions, and a pair of moisture measurement protrusions 312 are provided in each region. FIG. 8 shows a discharge cover 300 having a rounded triangular shape when viewed from a front with three pairs of moisture measurement protrusions 312 arranged in three regions roughly corresponding to the vertices of the triangular shape. The three pairs of moisture measurement protrusions 312 may be spaced apart from each other to measure moisture amounts in different regions.

A shape of the discharge cover 300 and/or the number of pairs of moisture measurement protrusions 312 may be varied as necessary. In some cases, the moisture measurement protrusions 312 may be densely arranged in a specific region, or may be evenly distributed at equal spacings.

An embodiment of the present disclosure may utilize an average value of the moisture amounts respectively measured by the pairs of moisture measurement protrusions 312, or differently set importance of the regions to determine a comprehensive moisture amount and utilize the comprehensive moisture amount.

The controller 115 may control the light irradiator 260 (and/or the fan 119 or the temperature adjuster 117) using the average value of the moisture amounts respectively measured by the pairs of moisture measurement protrusions 312, or may control the light irradiator 260, etc. using a value reflecting moisture amounts of the remaining moisture measurement protrusions 312 in a predetermined manner to a moisture amount of a pair of measurement protrusions 312 whose importance is set high.

Figure 10:
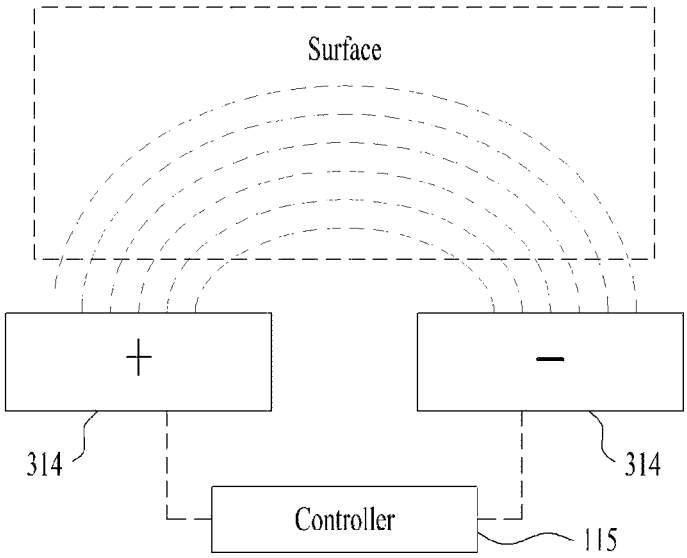
FIG. 10 is a view schematically showing a state in which a moisture amount is measured by a moisture measurement protrusion in an embodiment.

The controller 115 may be electrically connected to the plurality of moisture measurement protrusions 312, and the moisture amount may be determined based on the impedance measured between the first moisture measurement protrusion 315 and the second moisture measurement protrusion 316. The impedance may be defined as the bioelectrical impedance measured at the user's scalp or head as described above. FIG. 10 schematically shows a state in which the impedance is measured at the user's scalp through the pair of moisture measurement protrusions 312 according to an embodiment.

The pair of moisture measurement protrusions 312 may form the electric field on the scalp of the user by the mutual electric action. The electric field may be amplified as the moisture amount of the scalp increases and may decrease as the moisture amount decreases. When the electric field is formed by the pair of moisture measurement protrusions 312, the greater the moisture amount on the scalp, the lower the measured bioelectrical impedance, and the smaller the moisture amount, the higher the measured impedance.

The impedance measurement as described above may be performed by a current value, a voltage value, etc. generated between the pair of moisture measurement protrusions 312. For example, increase or decrease of the current value, the voltage value, etc. may be measured by increase or decrease of the impedance.

A change in the current value or the voltage value may correspond to the impedance formed in the electric field (i.e., the bioelectrical impedance). The controller 115 may calculate or determine the moisture amount using the impedance measured through the change in the current value or the voltage value measured by the pair of moisture measurement protrusions 312.

The controller 115 may derive a moisture amount corresponding to a current impedance based on a pre-stored or predetermined data map, or derive the moisture amount corresponding to the current impedance based on a pre-stored or predetermined derivation equation.

The controller 115 may be provided at one of the diffuser 200 and the main body 110 as described above, or may be provided at each of the diffuser 200 and the main body 110. The controller 115 may utilize the moisture amount determined in the above manner variously to control the hair dryer 100.

For example, the controller 115 may control the temperature adjuster 117 such that the temperature of the gas discharged through the gas outlet 150 increases as the moisture amount increases. When the moisture amount of the user's scalp or hair is high, the user may require scalp or hair drying. Accordingly, the controller 115 may control the temperature adjuster 117 to increase the gas temperature, thereby creating favorable conditions for drying the scalp or the hair.

When the moisture amount of the user's scalp or hair is small, the user may not require drying of the scalp or the hair, but rather is unpleasant with the discharge of the gas of the high temperature. Accordingly, the controller 115 may control the temperature adjuster 117 so as not to increase the gas temperature or so as to rather decrease the gas temperature.

In another example, the controller 115 may control the fan 119 such that the speed of the gas discharged through the gas discharge unit 150 increases as the moisture amount increases. When the moisture amount of the user's scalp or hair is high, it may be the situation in which the user requires the scalp or hair drying. Accordingly, the controller 115 may control the fan 119 to increase a rotational speed such that the speed of the gas discharged from the gas outlet 150 increases, thereby creating the favorable conditions for drying the scalp or the hair.

When the moisture amount of the user's scalp or hair is small, it may be the situation in which the user does not require the drying of the scalp or the hair, but rather is unpleasant with the discharge of the gas of the high temperature. Accordingly, the controller 115 may control the fan 119 such that the speed of the gas discharged from the gas outlet 150 corresponds to a low speed.

In yet another example, the controller 115 may control the light irradiator 260 such that the amount, intensity, or type of light irradiated by the light irradiator 260 increases as the moisture amount increases. When the moisture amount of the user's scalp or hair is high, the user may require the scalp or hair drying. The controller 115 may control the light irradiator 260 to turn on or to provide an amount of light increased than before (by, for example, turning on more light emitters 262), thereby creating the favorable conditions for drying the scalp or the hair.

When the moisture amount of the user's scalp or hair is small, the user may not require the drying of the scalp or the hair, but rather is unpleasant with a temperature increase due to the light irradiation. Accordingly, the controller 115 may control the light irradiator 260 to turn off at least some of the light emitters 262 so as not to emit as much light as before.

A control of the temperature adjuster 117, the fan 119, the light irradiator 260, etc. based on the moisture amount may not be necessarily limited as described above, and may be variously determined in a control strategic aspect for reflecting another request of the user or improving ease of use.

In one example, the light irradiator 260 may include the circuit board 265 and the light emitters 262 arranged on the circuit board 265 to irradiate the light, and the moisture measurement electrode 314 may be connected to the circuit board 265 to generate the voltage. FIG. 9 shows that the moisture measurement electrode 314 is connected to the circuit board 265 of the light irradiator 260 according to an embodiment. The moisture measurement electrode 314 may be provided such that one end thereof may be electrically connected to the circuit board 265 and the other end thereof may penetrate the protrusion base 313 and is exposed to the outside from the front end of the protrusion base 313.

Accordingly, embodiments disclosed herein may be advantageous in design because there is no need to construct a separate circuit for the moisture measurement protrusion 312 or the moisture measurement electrode 314, and may be able to efficiently generate the voltage on the moisture measurement electrode 314.

Figure 11:
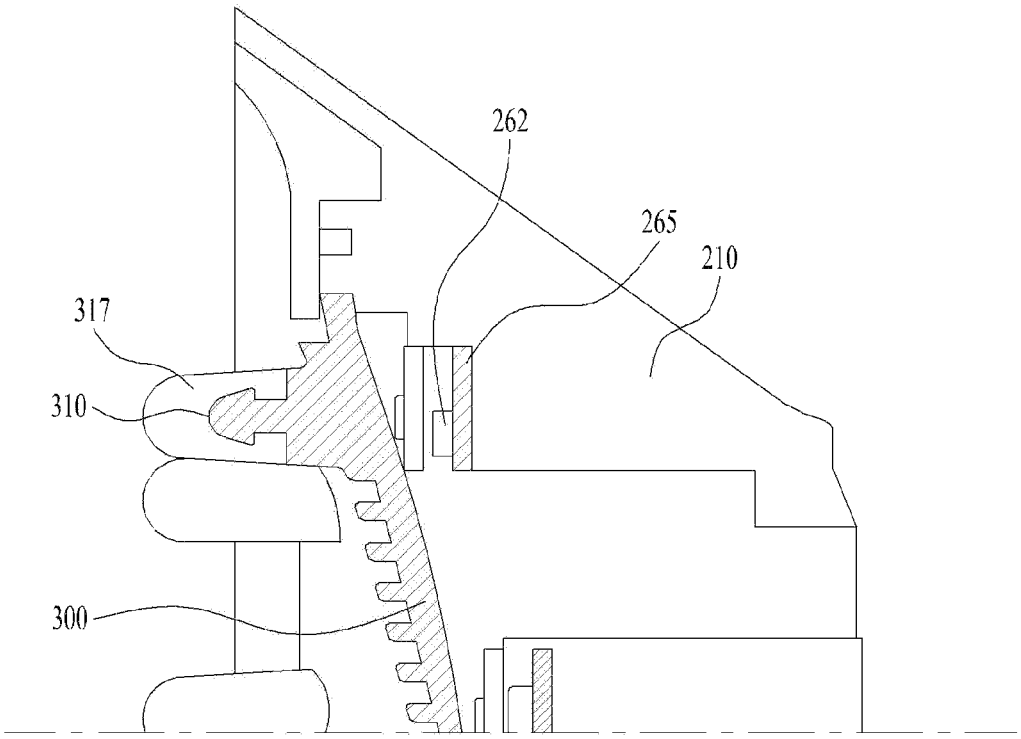
FIG. 11 is a view showing an arrangement relationship between a light emitter and a massage protrusion in a diffuser according to an embodiment of the present disclosure.

Referring to FIG. 11, in an embodiment of the present disclosure, the plurality of light emitters 262 may be arranged inside the diffusing case 210 to respectively face the plurality of massage protrusions 310.

The light irradiated from the light emitter 262 may be transmitted to the massage protrusion 310 through the gas discharge hole 305, or may be transmitted to the massage protrusion 310 by passing through the discharge cover 300, which may be made of a light transmissive material.

Accordingly, the light irradiated from the light emitter 262 may be transmitted to the scalp and the hair of the user through the massage protrusion 310 so that direct light transmission may be possible and a care effect of the scalp and the hair may be improved.

However, embodiments disclosed herein are not necessarily limited thereto. For example, some of the plurality of light emitters 262 may be respectively arranged rearward of the massage protrusions 310, and others may be arranged rearward of the gas discharge hole 305 to irradiate the light. Further, the plurality of light emitters 262 may be evenly distributed such that separation distances therebetween are uniform or may be concentrated in some regions as needed, regardless of an arrangement of the massage protrusions 310.

This application is related to co-pending U.S. application Ser. No. 17/077,915 filed on Oct. 22, 2020, Ser. No. 17/077,917 filed on Oct. 22, 2020, Ser. No. 17/077,921 filed on Oct. 22, 2020, Ser. No. 17/077,922 filed on Oct. 22, 2020, Ser. No. 17/077,927 filed on Oct. 22, 2020, Ser. No. 17/077,929 filed on Oct. 22, 2020, Ser. No. 17/085,385 filed on Oct. 30, 2020, and Ser. No. 17/077,119 filed on Oct. 22, 2020, the entire contents of which are incorporated by reference herein.

Embodiments disclosed herein may provide a diffuser and a hair dryer including the same capable of effectively managing scalp and hair of a user. In addition, embodiments disclosed herein may provide a diffuser and a hair dryer capable of effectively identifying conditions of user's scalp and hair. Embodiments disclosed herein may provide a diffuser and a hair dryer capable of improving ease of use and efficiency by providing appropriate care means based on conditions of user's scalp and hair.

A diffuser and a hair dryer including the same according to an embodiment of the present disclosure may include scalp and hair care means. The care means may include a massage protrusion, a light irradiator, and a controller that controls speed and temperature of gas. Embodiments disclosed herein may include moisture measurement means capable of measuring moisture amounts of scalp and hair of a user. The moisture measurement means may be provided in a form of a massage protrusion provided on a discharge cover of the diffuser.

Some of a plurality of massage protrusions may correspond to moisture measurement protrusions capable of measuring the moisture amounts of the scalp and the hair of the user. The moisture amount of the scalp may be measured through the moisture measurement protrusion to provide the appropriate care means.

There are limitations in using a common hygrometer or moisture sensor to measure the moisture of the user's scalp or hair. Accordingly, embodiments disclosed herein may provide a moisture measurement technology optimized for the moisture measurement of the scalp or the hair.

A voltage may be generated as the moisture measurement protrusion is connected to the light irradiator, so that the moisture measurement protrusion may measure the moisture. The voltage may be generated of a measured value may be transmitted as the moisture measurement protrusion is connected to a circuit board of the light irradiator. The moisture measurement protrusion may measure the moisture amount of the scalp based on a principle of a bioelectric impedance that changes based on the moisture amount.

When sensing through the moisture measurement protrusion starts, a voltage is applied to the moisture measurement protrusion, and an electric field is formed due to polarity occurrence resulted from the voltage generation. The electric field may be scattered along the scalp.

As the moisture amount increases, the electric field may be amplified, and an electrical capacity increases at the scalp on which the electric field is formed. The controller may calculate and determine the moisture amount based on measured values for the change as described above.

The controller may determine whether to operate the light irradiator, control a temperature of the gas, or control a speed of the gas based on the moisture amount.

Embodiments disclosed herein may be implemented as a hair dryer including a main body, a handle, and a diffuser. The main body may include a gas or air outlet to discharge gas therethrough, the handle may extend from the main body, and the diffuser may be removably coupled to the main body to introduce the gas discharged from the gas outlet therein and discharge the gas introduced therein to outside.

The diffuser may include a diffusing case and a discharge cover. The diffusing case may have a rear side coupled to the main body, and the gas discharged from the gas outlet may be introduced into the diffusing case through a gas inlet hole defined at the rear side. In addition, the discharge cover may be provided at a front side of the diffusing case, and the discharge cover may include a gas discharge hole to discharge the gas introduced into the diffusing case to outside.

The discharge cover may include a plurality of massage protrusions protruding forward to press a target located in front of the discharge cover, and the plurality of massage protrusions may include a moisture measurement protrusion provided to measure a moisture amount of the target.

The moisture measurement protrusion may include a protrusion base protruding forward to press the target, and a moisture measurement electrode provided in the protrusion base. At least a portion of the moisture measurement electrode may be exposed out of the protrusion base. The moisture measurement electrode may have an electrical polarity as a voltage is applied thereto.

The moisture measurement electrode may extend to penetrate the protrusion base along a longitudinal direction of the protrusion base and may be exposed to an outside through an end of the protrusion base. The moisture measurement protrusion may include a plurality of moisture measurement protrusions, the plurality of moisture measurement protrusions may include a first moisture measurement protrusion including a moisture measurement electrode having a first pole, and a second moisture measurement protrusion including a moisture measurement electrode having a second pole opposite to the first pole. The first moisture measurement protrusion and the second moisture measurement protrusion may be arranged to be adjacent to each other.

The plurality of massage protrusions may include a plurality of pairs of moisture measurement protrusions. Each pair of moisture measurement protrusions includes the first moisture measurement protrusion and the second moisture measurement protrusion.

The hair dryer may further include a controller electrically connected to the plurality of moisture measurement protrusions. The controller may determine the moisture amount based on an impedance measured between the first moisture measurement protrusion and the second moisture measurement protrusion.

The hair dryer may further include a temperature adjuster provided on the main body to adjust a temperature of the gas discharged through the gas outlet. The controller may control the temperature adjuster such that the temperature of the gas discharged through the gas outlet increases as the moisture amount increases.

The hair dryer may further include a fan provided to adjust a speed of the gas discharged through the gas outlet. The controller may control the fan such that the speed of the gas discharged through the gas outlet increases as the moisture amount increases.

The hair dryer may further include a light irradiator provided inside the diffusing case to irradiate light toward the discharge cover. The controller may control the light irradiator such that an amount of the light irradiated by the light irradiator increases as the moisture amount increases.

The light irradiator may include a circuit board and a light emitter provided on the circuit board to emit light. The moisture measurement electrode may be connected to the circuit board to receive the voltage. The light irradiator may include a plurality of light emitters arranged to respectively face the plurality of massage protrusions.

Embodiments disclosed herein may be implemented as a diffuser including a diffusing case having a rear side removably coupled to a main body of a hair dryer. Gas discharged from the main body may be introduced into the diffusing case through a gas inlet hole defined at the rear side. A discharge cover may be provided at a front side of the diffusing case. The discharge cover may include a gas discharge hole to discharge the gas introduced into the diffusing case to outside.

The discharge cover may include a plurality of massage protrusions protruding forward to press a target located in front of the discharge cover. The plurality of massage protrusions may include a moisture measurement protrusion provided to measure a moisture amount of the target.

The moisture measurement protrusion may include a protrusion base protruding forward to press the target and a moisture measurement electrode provided in the protrusion base. At least a portion of the moisture measurement electrode may be exposed out of the protrusion base. The moisture measurement electrode may have an electrical polarity as a voltage is applied thereto.

The moisture measurement protrusion may include a plurality of moisture measurement protrusions. The plurality of moisture measurement protrusions may include a first moisture measurement protrusion including a moisture measurement electrode having a first pole, and a second moisture measurement protrusion including a moisture measurement electrode having a second pole opposite to the first pole. The first moisture measurement protrusion and the second moisture measurement protrusion may be arranged to be adjacent to each other.

The plurality of massage protrusions may include a plurality of pairs of moisture measurement protrusions. Each pair of moisture measurement protrusions may include the first moisture measurement protrusion and the second moisture measurement protrusion.

Embodiments disclosed herein may provide the diffuser and the hair dryer including the same capable of effectively managing the scalp and the hair of the user. Embodiments disclosed herein may provide the diffuser and the hair dryer capable of effectively identifying the conditions of the user's scalp and hair.

Embodiments disclosed herein may provide the diffuser and the hair dryer capable of improving the ease of use and the efficiency by providing the appropriate care means based on the conditions of the user's scalp and hair.

Embodiments disclosed herein may be implemented as a hair dryer comprising a main body including an outlet through which fluid may be discharged, a handle extending from the main body, and a diffuser. The diffuser may include a case having a front side and a rear side removably coupled to the main body, an inlet provided at the rear side and configured to receive fluid discharged from the outlet, a cover provided at the front side of the case and having at least one discharge hole through which fluid inside of the case may be discharged, and a plurality of massage protrusions protruding forward from the cover to press a target in front of the cover. The plurality of massage protrusions include at least one moisture measurement protrusion configured to measure a moisture level of the target.

The at least one moisture measurement protrusion may include a moisture measurement electrode. At least a portion of the moisture measurement electrode may be exposed to an outside of the at least one moisture measurement protrusion. The moisture measurement electrode may be configured to have an electrical polarity when a voltage may be applied.

The moisture measurement electrode may penetrate an interior of the at least one moisture measurement protrusion and extend along a longitudinal direction. An end of the moisture measurement electrode may be exposed to an outside of the at least one moisture measurement protrusion at a front end of the at least one moisture measurement protrusion.

The at least one moisture measurement protrusion may include a first moisture measurement protrusion having a first electrode configured to have a first pole, and a second moisture measurement protrusion provided adjacent to the first moisture measurement protrusion and including a second electrode configured to have a second pole opposite to the first pole.

The at least one moisture measurement protrusion may be a plurality of pairs of moisture measurement protrusions. Each pair may have the first moisture measurement protrusion and the second moisture measurement protrusion.

A controller may be electrically connected to the plurality of moisture measurement protrusions. The controller may be configured to determine the moisture level based on an impedance measured between the first moisture measurement protrusion and the second moisture measurement protrusion.

A temperature adjuster may be provided in the main body to adjust a temperature of the fluid discharged through the outlet. The controller may be configured to control the temperature adjuster to increase a temperature of the fluid as the moisture level increases.

A fan may be provided to adjust a speed of the fluid discharged through the outlet. The controller may be configured to control the fan such that the speed of the fluid discharged through the outlet increases as the moisture level increases.

A light may be provided inside the case to irradiate light toward the cover. The controller may be configured to control the light to increase a light amount as the moisture level increases.

The light may include a circuit board and at least one light emitter provided on the circuit board to emit light. The at least one moisture measurement electrode may be connected to the circuit board to receive the voltage.

The at least one light emitter may include a plurality of light emitters arranged to align with the plurality of massage protrusions. The plurality of massage protrusions may be made of a light transmissive material so that light emitted from the plurality of light emitters may be transmitted through the plurality of massage protrusions.

Embodiments disclosed herein may be provided as a diffuser including a case having a front side and a rear side, the rear side configured to be removably coupled to a hair dryer, an inlet provided at the rear side and configured to receive fluid discharged from the hair dryer, and a cover provided at a front side of the case. The cover may include at least one discharge hole through which fluid inside of the case may be discharged, a plurality of first protrusions protruding forward from the cover to press a target located in front of the cover, and at least one moisture sensor configured to measure a moisture amount of the target.

The moisture sensor may include at least one second protrusion protruding forward to press the target, the second protrusion having a same shape and size as the plurality of first protrusions, and an electrode provided in the second protrusion. At least a portion of the electrode may be exposed to an outside of the second protrusion and may be configured to have an electrical polarity as a voltage may be applied.

The at least one second protrusion may include a first moisture measurement protrusion including a first electrode configured to have a first pole and a second moisture measurement protrusion provided adjacent to the first moisture measurement protrusion and including a second electrode configured to have a second pole opposite to the first pole. The at least one second protrusion may be a plurality of pairs of second protrusions, each pair including the first moisture measurement protrusion and the second moisture measurement protrusion.

Embodiments disclosed herein may be implemented as a hair dryer comprising a main body having an inlet and an outlet, a fan to suction fluid through the inlet and discharge fluid out of the outlet, a controller to control a speed of the fan, and a diffuser provided at the outlet and configured to diffuse air discharged out of the outlet. The diffuser may have a moisture level sensor. The controller may be configured to determine a moisture amount based on a sensing by the moisture level sensor and control the speed of the fan based on the determined moisture amount.

The moisture level sensor may comprise a cathode, and an anode provided adjacent to the cathode. The moisture level sensor measures an impedance, and the controller may be configured to determine the moisture amount based on the measured impedance. The moisture level sensor may be provided as at least one massage protrusion provided on a front surface of the diffuser and configured to press on a target in front of the diffuser.

A light may have a circuit board provided inside of the diffuser and at least one light emitting diode to emit light. The controller may be configured to control the light based on the determined moisture amount. A temperature adjuster may be provided in the main body to change a temperature of the fluid discharged from the outlet. The controller may be configured to control the temperature adjuster based on the determined moisture amount.

In this specification, duplicate descriptions of the same components are omitted. Further, in this specification, it will be understood that when a component is referred to as being "connected with" another component, the component may be directly connected with the other component or intervening components may also be present. In contrast, it will be understood that when a component is referred to as being "directly connected with" another component in this specification, there are no intervening components present. The terminology used herein is for the purpose of describing a specific embodiment only and is not intended to be limiting of the present disclosure. The singular forms "a" and "an" are intended to include the plural forms as well, unless the context clearly indicates otherwise.

It will be further understood that the terms "comprises", "comprising", "includes", and "including" specify the presence of the certain features, numbers, steps, operations, elements, and parts or combinations thereof, but do not preclude the presence or addition of one or more other features, numbers, steps, operations, elements, and parts or combinations thereof. The term 'and/or' includes a combination of a plurality of listed items or one of the plurality of listed items. In this specification, 'A or B' may include 'A', 'B', or 'both A and B'.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A hair dryer, comprising:

a main body including an outlet through which fluid is discharged;

a handle extending from the main body; and a diffuser, including:

a case having a front side and a rear side removably coupled to the main body;

an inlet provided at the rear side and configured to receive fluid discharged from the outlet;

a cover provided at the front side of the case and having at least one discharge hole through which fluid inside of the case is discharged; and a plurality of massage protrusions protruding forward from the cover to press a target in front of the cover, wherein the plurality of massage protrusions includes at least one moisture measurement protrusion configured to measure a moisture level of the target.

2. The hair dryer of claim 1, wherein the at least one moisture measurement protrusion includes a moisture measurement electrode, and wherein at least a portion of the moisture measurement electrode is exposed to an outside of the at least one moisture measurement protrusion, and the moisture measurement electrode is configured to have an electrical polarity when a voltage is applied.

3. The hair dryer of claim 2, wherein the moisture measurement electrode penetrates an interior of the at least one moisture measurement protrusion and extends along a longitudinal direction, and an end of the moisture measurement electrode is exposed to an outside of the at least one moisture measurement protrusion at a front end of the at least one moisture measurement protrusion.

4. The hair dryer of claim 2, wherein the at least one moisture measurement protrusion includes:

a first moisture measurement protrusion having a first electrode configured to have a first pole; and a second moisture measurement protrusion provided adjacent to the first moisture measurement protrusion and including a second electrode configured to have a second pole opposite to the first pole.

5. The hair dryer of claim 4, wherein the at least one moisture measurement protrusion comprises a plurality of pairs of moisture measurement protrusions, each pair having the first moisture measurement protrusion and the second moisture measurement protrusion.

6. The hair dryer of claim 4, further comprising a controller electrically connected to the plurality of moisture measurement protrusions, wherein the controller is configured to determine the moisture level based on an impedance measured between the first moisture measurement protrusion and the second moisture measurement protrusion.

7. The hair dryer of claim 6, further comprising a temperature adjuster provided in the main body to adjust a temperature of the fluid discharged through the outlet, wherein the controller is configured to control the temperature adjuster to increase a temperature of the fluid as the moisture level increases.

8. The hair dryer of claim 6, further comprising a fan provided to adjust a speed of the fluid discharged through the outlet, wherein the controller is configured to control the fan such that the speed of the fluid discharged through the outlet increases as the moisture level increases.

9. The hair dryer of claim 6, further comprising a light provided inside the case to irradiate light toward the cover, wherein the controller is configured to control the light to increase a light amount as the moisture level increases.

10. The hair dryer of claim 9, wherein the light includes a circuit board and at least one light emitter provided on the circuit board to emit light, wherein the at least one moisture measurement electrode is connected to the circuit board to receive a voltage.

11. The hair dryer of claim 10, wherein the at least one light emitter includes a plurality of light emitters arranged to align with the plurality of massage protrusions, and the plurality of massage protrusions are made of a light transmissive material so that light emitted from the plurality of light emitters is transmitted through the plurality of massage protrusions.

12. A diffuser, comprising:

a case having a front side and a rear side, the rear side configured to be removably coupled to a hair dryer;

an inlet provided at the rear side and configured to receive fluid discharged from the hair dryer;

a cover provided at a front side of the case, wherein the cover includes at least one discharge hole through which fluid inside of the case is discharged;

a plurality of first protrusions protruding forward from the cover to press a target located in front of the cover; and a plurality of second protrusions protruding forward from the cover to press a target located in front of the cover, wherein at least one second protrusion of the plurality of second protrusions includes a moisture sensor configured to measure a moisture amount of the target.

13. The diffuser of claim 12, wherein the at least one second protrusion has a same shape and size as the plurality of first protrusions; and wherein the moisture sensor includes:

an electrode provided in the at least one second protrusion, wherein at least a portion of the electrode is exposed to an outside of the at least one second protrusion and is configured to have an electrical polarity as a voltage is applied.

14. The diffuser of claim 13, wherein the at least one second protrusion includes a first moisture measurement protrusion and/or a second moisture measurement protrusion, wherein the first moisture measurement protrusion includes a first electrode configured to have a first pole, and wherein the second moisture measurement protrusion is provided adjacent to the first moisture measurement protrusion and includes a second electrode configured to have a second pole opposite to the first pole.

15. The diffuser of claim 13, wherein the at least one second protrusion comprises a plurality of pairs of second protrusions, each pair including the first moisture measurement protrusion and the second moisture measurement protrusion.

16. A hair dryer comprising the diffuser of claim 12.

17. A hair dryer, comprising:

a main body having an inlet and an outlet;

a fan to suction fluid through the inlet and discharge fluid out of the outlet;

a controller to control a speed of the fan; and a diffuser provided at the outlet and configured to diffuse air discharged out of the outlet, the diffuser having at least one massage protrusion protruding forward from the cover, wherein the at least one massage protrusion includes a moisture level sensor, and wherein the controller is configured to determine a moisture amount based on a sensing by the moisture level sensor and control the speed of the fan based on the determined moisture amount.

18. The hair dryer of claim 17, wherein the moisture level sensor comprises:

a cathode; and an anode provided adjacent to the cathode, wherein the moisture level sensor measures an impedance, and the controller is configured to determine the moisture amount based on the measured impedance.

19. The hair dryer of claim 17, wherein the at least one massage protrusion is provided on a front surface of the diffuser and configured to press on a target in front of the diffuser.

20. The hair dryer of claim 17, further comprising:

a light having a circuit board provided inside of the diffuser and at least one light emitting diode to emit light, wherein the controller is configured to control the light based on the determined moisture amount; and a temperature adjuster provided in the main body to change a temperature of the fluid discharged from the outlet, wherein the controller is configured to control the temperature adjuster based on the determined moisture amount.

* * * * *